US008430583B2

(12) United States Patent
Suzuki

(10) Patent No.: US 8,430,583 B2
(45) Date of Patent: Apr. 30, 2013

(54) PRINTING DEVICE AND METHOD OF CONTROLLING THE PRINTING DEVICE WHICH DETECTS A SHAPE OF A PRINTING MEDIUM IN ORDER TO CONTROL A PRINTING POSITION

(75) Inventor: Toshiyuki Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 344 days.

(21) Appl. No.: 12/897,890

(22) Filed: Oct. 5, 2010

(65) Prior Publication Data

US 2011/0081187 A1 Apr. 7, 2011

(30) Foreign Application Priority Data

Oct. 6, 2009 (JP) ..... 2009-232538

(51) Int. Cl.
*B41J 11/44* (2006.01)
*B41J 11/00* (2006.01)
*G03G 15/00* (2006.01)

(52) U.S. Cl.
USPC ..... 400/76; 400/579; 399/389; 399/394; 399/395

(58) Field of Classification Search ..... 400/76, 400/579; 399/394, 395, 389; 101/481
See application file for complete search history.

(56) References Cited

U.S. PATENT DOCUMENTS 5,609,428 A 3/1997 Tanaka et al.
8,215,851 B2 * 7/2012 Onoda ..... 400/76

FOREIGN PATENT DOCUMENTS

JP 05-139589 6/1993
JP 08-091633 4/1996
JP 08-305098 11/1996
JP 2003146485 * 5/2003

* cited by examiner

*Primary Examiner* — Judy Nguyen
*Assistant Examiner* — Blake A Tankersley
(74) *Attorney, Agent, or Firm* — Workman Nydegger

(57) ABSTRACT

Provided is a printing device including: a transport unit configured to transport a sheet-shape printing medium; a printing unit configured to print an image on the printing medium transported by the transport unit; a shape detection unit configured to detect the shape of edges of the printing medium; a position detection unit configured to detect the positions of the edges when an image is printed on the printing medium by the printing unit; and a first determination unit configured to determine the attitude of the printing medium based on the shape of the edges detected by the shape detection unit and the positions of the edges detected by the position detection unit, wherein the printing unit controls a printing position based on the attitude of the printing medium determined by the first determination unit and performs printing on the printing medium.

5 Claims, 16 Drawing Sheets

| FIG. 11A |
| --- |
| FIG. 11B |

| FIG. 14A |
| --- |
| FIG. 14B |

PRINTING DEVICE AND METHOD OF CONTROLLING THE PRINTING DEVICE WHICH DETECTS A SHAPE OF A PRINTING MEDIUM IN ORDER TO CONTROL A PRINTING POSITION

Japanese Patent Application No. 2009-232538 filed Oct. 6, 2009 is incorporated by reference in its entirety herein.

BACKGROUND

1. Technical Field

The present invention relates to a printing device for performing printing on a printing medium and a method of controlling the printing device.

2. Related Art

In a technique described in JP-A-8-305098, first, at the time of transport of a sheet-shaped printing medium, two edge positions of the printing medium of a direction orthogonal to a transport direction of the printing medium are detected. Subsequently, based on the detected two positions, a slant of the printing medium relative to the transport direction of the printing medium is calculated. Subsequently, based on the calculation result, an image is slanted with respect to the transport direction of the printing medium and printing on the printing medium is performed. Accordingly, the image is printed on the printed medium without relative displacement.

However, in the technique described in JP-A-8-305098, the slant of the printing medium is calculated based on the result of detecting the edge positions of the printing medium. Therefore, for example, if irregularities are present in the edges of the printing medium, the slant of the printing medium may be falsely recognized. As a result, it is difficult to print the image on the printing medium without relative displacement.

SUMMARY

An advantage of some aspects of the invention is that an image can be printed on a printing medium without relative displacement, even when irregularities are present in edges of a printing medium.

According to an aspect of the invention, there is provided a printing device including: a transport unit configured to transport a sheet-shape printing medium; a printing unit configured to print an image on the printing medium transported by the transport unit; a shape detection unit configured to detect the shape of edges of the printing medium; a position detection unit configured to detect the positions of the edges when an image is printed on the printing medium by the printing unit; and a first determination unit configured to determine the attitude of the printing medium based on the shape of the edges detected by the shape detection unit and the positions of the edges detected by the position detection unit, wherein the printing unit adjusts a printing position based on the attitude of the printing medium determined by the first determination unit and performs printing on the printing medium.

By this configuration, it is possible to determine the attitude of the printing medium in consideration of the shape of the edges of the printing medium. Accordingly, since printing on the printing medium is performed by controlling the printing position based on the attitude of the printing medium, it is possible to print an image on the printing medium without relative displacement, even when irregularities are present in the edges of the printing medium.

The shape detection unit may detect a plurality of positions of the target edges which are edges of the printing medium in a direction orthogonal to a transport direction as the shape of the edges, the position detection unit may detect two positions of the plurality of positions when the image is printed on the printing medium by the printing unit, and the first determination unit may determine the attitude of the printing medium based on an angle between a straight line passing the two positions of the plurality of positions detected by the shape detection unit and a straight line passing the two positions detected by the position detection unit.

By this configuration, it is possible to more adequately determine the attitude of the printing medium.

The shape detection unit may include a plurality of first sensors arranged at positions facing positions passing the target edges in parallel along the transport direction so as to detect the positions of the facing target edges.

By this configuration, it is possible to easily detect the positions of the edges of the printing medium.

The plurality of first sensors may be arranged at an interval, which is an integral multiple of 2 times or more of a predetermined distance, so as to detect the positions of the facing target edges whenever the printing medium is transported by the predetermined distance, and the shape detection unit may include a position acquisition unit configured to synthesize detection results of the plurality of first sensors and to create the plurality of positions.

By this configuration, it is possible to reduce the number of first sensors necessary for detecting the positions of the edges.

The shape detection unit may include second sensors arranged at positions facing positions passing the target edges with the predetermined distance from any one of the plurality of first sensors so as to detect the positions of the facing target edges, a second determination unit configured to determine a variation in attitude of the printing medium based on the positions of the target edges detected by the plurality of first sensors and the positions of the target edges detected by the plurality of second sensors, and a correction unit configured to correct the plurality of positions detected by the first sensors based on the variation in attitude of the printing medium determined by the second determination unit.

By this configuration, it is possible to adequately detect the shape of the edges of the printing medium even when the attitude of the printing medium is varied at the time of the detection of the positions of the edges.

According to another aspect of the invention, there is provided a method of controlling a printing device for transporting a sheet-shaped printing medium and printing an image on the transporting printing medium, the method including: detecting the shape of edges of the printing medium before the image is printed on the printing medium; detecting the positions of the edges when the image is printed on the printing medium; determining the attitude of the printing medium based on the detected shape of the edges and the detected positions of the edges, wherein a printing position is controlled based on the determined attitude of the printing medium so as to perform printing on the printing medium.

By this configuration, it is possible to determine the attitude of the printing medium in consideration of the shape of the edges of the printing medium. Accordingly, since printing on the printing medium is performed by controlling the printing position based on the attitude of the printing medium, it is possible to print an image on the printing medium without relative displacement, even when irregularities are present in the edges of the printing medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

In the present embodiment, an example of applying a printing device according to the invention to a line type ink jet printing device for transporting paper P in a state in which a print surface is turned upward and performing printing on the transported paper P using printing head bars 19 and 31 provided above a transport path and covering a paper width will be described.

The printing device of the present embodiment detects a plurality of edge positions of the paper P in a direction orthogonal to a transport direction of the paper P before printing on the paper P. Subsequently, at the time of printing on the paper P, two of the plurality of positions are detected. Subsequently, based on the detection result of the plurality of positions and the detection result of the two positions, the attitude of the paper P (for example, the position of the paper P, the slant of the paper P, or the like) is calculated. Subsequently, based on the calculation result, a print position is adjusted so as to print an image (for example, scale, the image to be printed or the like) on the paper P without relative displacement.

Configuration

Figure 1:
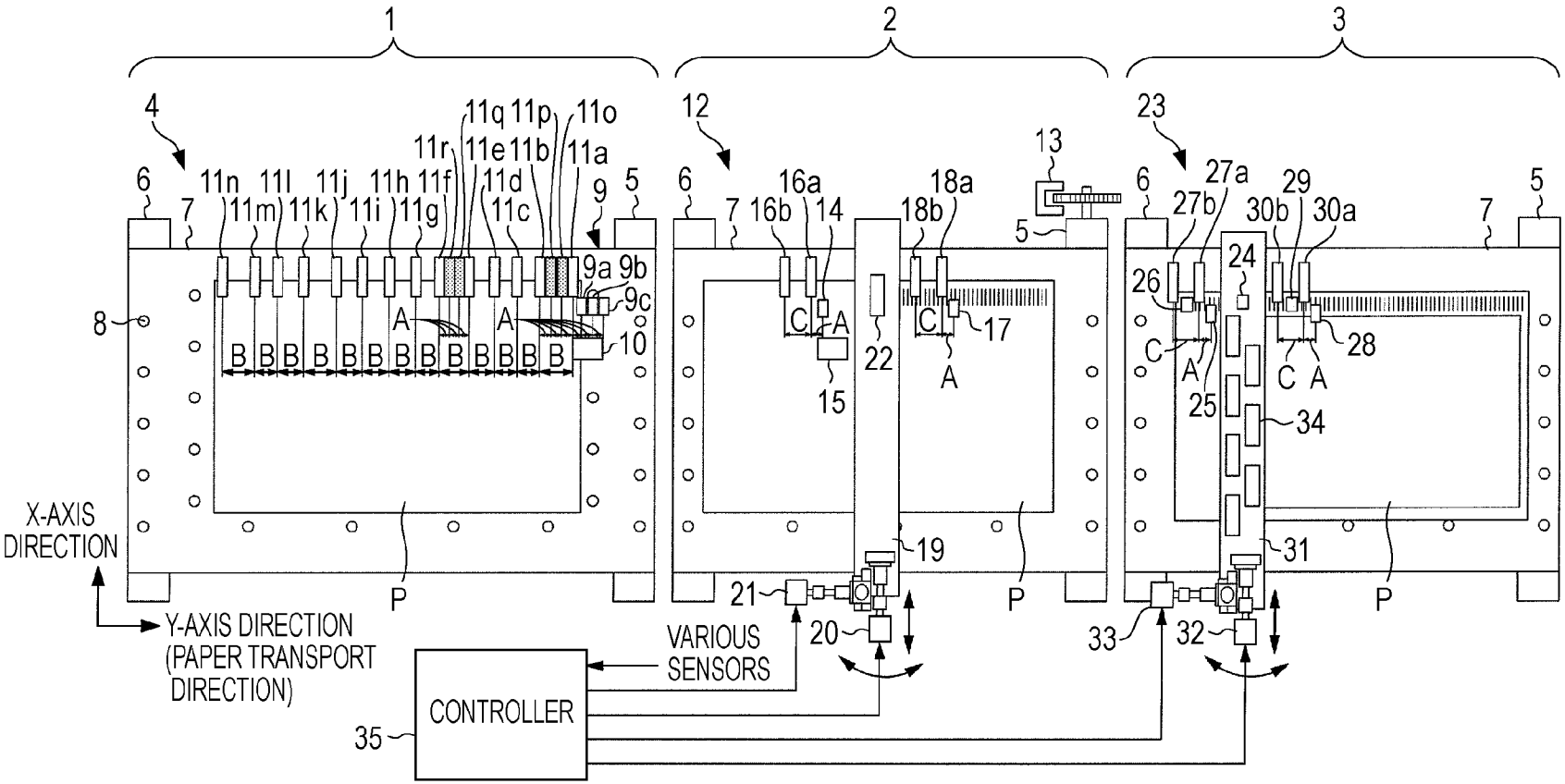
FIG. 1 is a conceptual diagram showing the configuration of a printing device.

FIG. 1 is a conceptual diagram showing the configuration of a printing device according to the present embodiment.

As shown in FIG. 1, the printing device includes a profile acquisition unit 1, an on-paper mark printing unit 2, and a printing unit 3. The profile acquisition unit 1, the on-paper mark printing unit 2 and the printing unit 3 are respectively arranged in parallel along a paper transport direction. The paper transport direction is a direction in which paper P which is a printing medium of a sheet shape is transported. As the paper P, for example, printing paper cut into a rectangular shape may be used. The arrangement order of the profile acquisition unit 1, the on-paper mark printing unit 2 and the printing unit 3 is set to the order of the profile acquisition unit 1, the on-paper mark printing unit 2 and the printing unit 3 from the downstream side to the upstream side of the paper transport direction.

The profile acquisition unit 1 includes a transport unit 4.

The transport unit 4 is configured by winding a transport belt 7 on a driving roller 5, a driven roller 6 and a tension roller (not shown). In the transport unit 4, the driving roller 5 is rotated and driven and the transport belt 7 is rotated by the rotation of the driving roller 5.

Then, the paper P fed to the transport belt 7 is transported in the paper transport direction. In addition, the feeding of the paper P is performed such that a long edge thereof is parallel with the paper transport direction.

A plurality of through-holes 8 is formed in the transport belt 7. The transport unit 4 generates negative pressure in a suction fan (not shown) provided between the driving roller 5 and the driven roller 6 and sucks the paper P through the through-holes 8 by the generated negative pressure.

The profile acquisition unit 1 includes sensors such as paper arrival sensors 9*a* to 9*c*, a tip end position sensor 10, and profile acquisition sensors 11*a* to 11*r*. These sensors are arranged above the transport unit 4. Each of the sensors detects the arrival of the paper P to the lower side of the sensor or the position of the edge of the paper P, and outputs the detection result to a controller 35.

Figure 2A:
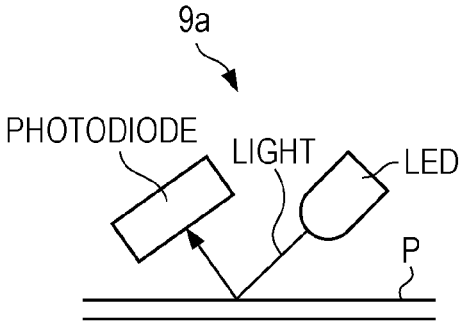
FIGS. 2A and 2B are conceptual diagrams showing the configuration of a paper arrival sensor.
Figure 2B:
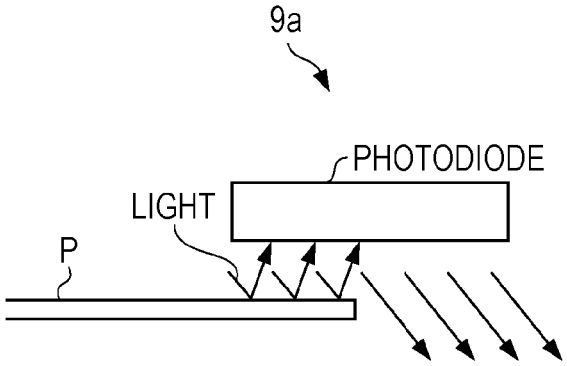

FIG. 2 is a conceptual diagram showing the configuration of the paper arrival sensor 9*a*. FIG. 2A is a side view when the paper arrival sensor 9*a* is viewed from a direction orthogonal to the paper transport direction. FIG. 2B is a front view when the paper arrival sensor 9*a* is viewed from the paper transport direction.

The paper arrival sensors 9*a* to 9*c* are provided at the downstream side of the paper transport direction and at the left side when facing the paper transport direction. Each of the paper arrival sensors 9*a* to 9*c* is arranged in parallel along the paper transport direction. The arrangement order of the paper arrival sensors 9*a* to 9*c* is set to the order of 9*a*, 9*b* and 9*c* from the downstream side to the upstream side of the paper transport direction. Each of the distances between adjacent paper arrival sensors 9*a* to 9*c* is a set distance A. Each of the paper arrival sensors 9*a* to 9*c* detects whether the paper P arrives at the lower side of the sensor.

As the paper arrival sensors 9*a* to 9*c*, for example, a sensor composed of a Light Emitting Diode (LED) and a photo diode may be used. When the sensor composed of the LED and the photo diode is used, the paper P has a color capable of easily reflecting light such as white light and the transport belt 7 has a color capable of easily absorbing light such as black light. As shown in FIG. 2, the LED irradiates light to the lower side of the sensor and the photo diode detects the light reflected from the irradiated light. Subsequently, the photo diode determines whether the reflected light can be detected or not. If it is determined that the reflected light could be detected, it is determined that the paper P arrives at the lower side of the sensor. In contrast, if it is determined that the reflected light could not be detected, it is determined that the paper P has not arrived at the lower side of the sensor.

The tip end position sensor 10 is provided at the same position as the paper arrival sensors 9*a* to 9*c* in the paper transport direction and at the right side of the paper arrival sensors 9*a* to 9*c* when facing the paper transport direction. The tip end position sensor 10 detects the position of the edge of the paper transport direction of the paper P. The position of the edge of the paper transport direction of the paper P is detected as a coordinate value (x, y) of an xy coordinate system. The xy coordinate system is a coordinate system having a position set in a printing apparatus as an original point (0, 0) and having a y axis using the paper transport direction as a positive direction and an x axis using a left direction when facing the paper transport direction as a positive direction.

As the tip end position sensor 10, for example, similar to the paper arrival sensors 9*a* to 9*c*, a sensor composed of an LED and a photo diode may be used. If the sensor composed of the LED and the photo diode is used, the LED irradiates light to the lower side of the sensor and the photo diode receives the light reflected from the irradiated light. Based on the reception state of the photo diode and the coordinate value of the position of the light irradiated by the LED, the position of the edge of the paper transport direction of the paper P is detected.

The profile acquisition sensors 11*a* to 11*n* are provided at the left side of the paper arrival sensors 9*a* to 9*c* when facing the paper transport direction. The profile acquisition sensors 11*a* to 11*n* are provided at positions facing positions where target edges of the paper P pass. The target edges are edges of a direction orthogonal to the paper transport direction of the paper P and are edges located at the left side when facing the paper transport direction. Each of the profile acquisition sensors 11*a* to 11*n* is arranged in parallel along the paper transport direction. The arrangement order of the profile acquisition sensors 11*a* to 11*n* are set to the order of 11*a*, 11*b*, 11*c*, 11*d*, 11*e*, 11*f*, 11*g*, 11*h*, 11*i*, 11*j*, 11*k*, 11*l*, 11*m* and 11*n* from the downstream side to the upstream side of the paper transport direction. Each of the distances between adjacent profile acquisition sensors 11*a* to 11*n* is set to a distance B. The distance B is three times the distance A. In addition, the distance between the profile acquisition sensor 11*a* and the paper arrival sensor 9*a* in the paper transport direction is the distance A. Each of the profile acquisition sensors 11*a* to 11*n* detects the positions of the target edges of the facing paper P. The positions of the target edges of the paper P are detected as the coordinate value (x, y) of the xy coordinate system.

As the profile acquisition sensors 11*a* to 11*n*, for example, similar to the paper arrival sensors 9*a* to 9*c*, a sensor composed of an LED and a photo diode may be used. When the sensor composed of the LED and the photo diode is used, the LED irradiates light to the lower side of the sensor and the photo diode receives the light reflected from the irradiated light. Based on the reception state of the photo diode and the coordinate value of the irradiation position of the light by the LED, the positions of the target edges are detected.

In addition, although an example in which the distance B is three times the distance A is described in the present embodiment, another configuration may be employed. For example, the distance B may be equal to the distance A or may be two times the distance A or an integral times of four times or more the distance A.

The profile acquisition sensors 11*o* and 11*p* are provided between the profile acquisition sensor 11*a* and the profile acquisition sensor 11*b*. The profile acquisition sensors 11*o* and 11*p* are provided at positions facing positions where the target edges of the paper P pass. Each of the profile acquisition sensors 11*o* and 11*p* is arranged in parallel along the paper transport direction. The arrangement order of the profile acquisition sensors 11*o* and 11*p* are set to the order of 11*o* and 11*p* from the downstream side to the upstream side of the paper transport direction. Each of the distances between adjacent profile acquisition sensors 11*a*, 11*o*, 11*p* and 11*b* is the distance A. Each of the profile acquisition sensors 11*o* and 11*p* detects the positions of the target edges of the facing paper P. As the profile acquisition sensors 11*o* and 11*p*, for example, the same sensors as the profile acquisition sensors 11*a* to 11*n* may be used.

The profile acquisition sensors 11*q* and 11*r* are provided between the profile acquisition sensor 11*e* and the profile acquisition sensor 11*f*. The profile acquisition sensors 11*q* and 11*r* are provided at positions facing positions where the target edges of the paper P pass. Each of the profile acquisition sensors 11*q* and 11*r* is arranged in parallel along the paper transport direction. The arrangement order of the profile acquisition sensors 11*q* and 11*r* are set to the order of 11*q* and 11*r* from the downstream side to the upstream side of the paper transport direction. Each of the distances between adjacent profile acquisition sensors 11*e*, 11*r*, 11*q* and 11*r* is the distance A. Each of the profile acquisition sensors 11*q* and 11*r* detects the positions of the target edges of the facing paper P. As the profile acquisition sensors 11*q* and 11*r*, for example, the same sensors as the profile acquisition sensors 11*a* to 11*n* may be used.

The on-paper mark printing unit 2 includes a transport unit 12.

The basic configuration of the transport unit 12 is equal to the transport unit 4.

By this configuration, the paper P transported to a most downstream side of the paper transport direction by the transport unit 4 is sucked to the transport unit 12. Then, the paper P is transported in the paper transport direction.

However, the transport unit 12 is different from the transport unit 4 in that a rotary encoder 13 is included.

The rotary encoder 13 is provided on a rotation shaft of the driving roller 5 of the transport unit 12. The rotary encoder 13 detects the number of revolutions per minute of the rotation shaft and detects the rotation amount of the transport belt 7 of the transport unit 12 based on the detection result.

Although an example in which the rotation amount of the transport belt 7 of the transport unit 12 is detected using the rotary encoder 13 is described in the present embodiment, another configuration may be employed. For example, an on-belt encoder configured on the surface of transport belt 7 may be used.

The on-paper mark printing unit 2 includes sensors such as a paper arrival sensor 14, a tip end position sensor 15, attitude detection sensors 16*a* and 16*b*, a paper arrival sensor 17 and attitude detection sensors 18*a* and 18*b*. These sensors 14, 15, 16*a*, 16*b*, 17, 18*a* and 18*b* are arranged above the transport unit 12. Each of the sensors detects the arrival of the paper P to the lower side of the sensor or the position of the edge of the paper P, and outputs the detection result to the controller 35.

The paper arrival sensor 14 is provided at the upstream side in the paper transport direction from the printing head bar 19 and at the left side when facing the paper transport direction. The paper arrival sensor 14 detects whether the paper P arrives at the lower side of the sensor or not. As the paper arrival sensor 14, for example, the same sensor as the paper arrival sensors 9*a* to 9*c* may be used.

The tip end position sensor 15 is provided at the upstream side in the paper transport direction from the printing head bar 19 and at the right side of the paper arrival sensor 14 when facing the paper transport direction. The tip end position sensor 15 detects the position of the edge of the paper transport direction of the paper P. As the tip end position sensor 15, for example, the same sensor as the tip end position sensor 10 may be used.

The attitude detection sensors 16*a* and 16*b* are provided at the upstream side in the paper transport direction from the paper arrival sensor 14 and at the left side of the paper arrival sensor 14 when facing the paper transport direction. The attitude detection sensors 16*a* and 16*b* are provided at positions facing positions where the target edges of the paper P pass. Each of the attitude detection sensors 16*a* and 16*b* is arranged in parallel along the paper transport direction. The arrangement order of the attitude detection sensors 16*a* and 16*b* is set to the order of 16*a* and 16*b* from the downstream side to the upstream side of the paper transport direction. The distance between adjacent position detection sensors 16*a* and 16*b* is a set distance C. The distance C is three times the distance A. The distance between the attitude detection sensor 16*a* and the paper arrival sensor 14 in the paper transport direction is the distance A. Each of the attitude detection sensors 16*a* and 16*b* detects the positions of the target edges of the facing paper P. As the attitude detection sensors 16*a* and 16*b*, for example, the same sensor as the profile sensors 11*a* to 11*n* may be used.

In addition, although an example in which the distance C is three times the distance A is described in the embodiment, another configuration may be employed. For example, the distance C may be equal to the distance A or may be two times the distance A or an integral times of four times or more the distance A.

The paper arrival sensor 17 is provided at the downstream side in the paper transport direction from the printing head bar 19 and the left side when facing the paper transport direction. The paper arrival sensor 17 detects whether the paper P arrives at the lower side of the sensor or not. As the paper arrival sensor 17, for example, the same sensor as the paper arrival sensors 9*a* to 9*c* may be used.

The attitude detection sensors 18*a* and 18*b* are provided at the downstream side in the paper transport direction from the printing head bar 19, at the upstream side in the paper transport direction from the paper arrival sensor 17, and at the left side of the paper arrival sensor 17 when facing the paper transport direction. The attitude detection sensors 18*a* and 18*b* are provided at positions facing positions where the target edges of the paper P pass. Each of the attitude detection sensors 18*a* and 18*b* is arranged in parallel along the paper transport direction. The arrangement order of the attitude detection sensors 18*a* and 18*b* is set to the order of 18*a* and 18*b* from the downstream side to the upstream side of the paper transport direction. The distance between adjacent position detection sensors 18*a* and 18*b* is the distance C. The distance between the attitude detection sensor 18*a* and the paper arrival sensor 17 in the paper transport direction is the distance A. Each of the attitude detection sensors 18*a* and 18*b* detects the positions of the target edges of the facing paper P. As the attitude detection sensors 18*a* and 18*b*, for example, the same sensor as the profile acquisition sensors 11*a* to 11*n* may be used.

The on-paper mark printing unit 2 includes the printing head bar 19, a head movement motor 20 and a head rotation motor 21. These are arranged above the transport unit 12.

The printing head bar 19 is a line head extending in a direction orthogonal to the paper transport direction. The printing head bar 19 discharges an ink from a recording head 22 onto the paper P passing the lower side of the printing head bar 19 and prints a scale, according to an instruction from the controller 35. As a scale, for example, a plurality of line images arranged along the paper transport direction may be used. The printing location of the scale is in vicinity of the target edge of the paper P.

The head movement motor 20 is provided on an end of the printing head bar 19. The head movement motor 20 delivers power to a guide mechanism (not shown) according to an instruction from the controller 35 so as to displace the printing head bar 19 in a longitudinal direction.

The head rotation motor 21 is provided on an end of the printing head bar 19. The head rotation motor 21 delivers power to a rotation driving mechanism (not shown) according to an instruction from the controller 35 so as to rotate the printing head bar 19 in a horizontal plane.

The printing unit 3 includes a transport unit 23.

The basic configuration of the transport unit 23 is equal to the transport unit 4.

By this configuration, the paper P transported to a most downstream side of the paper transport direction by the transport unit 12 is sucked to the transport unit 23. Then, the paper P is transported in the paper transport direction.

The printing unit 3 includes sensors such as a printing encoder 24, a paper arrival sensor 25, a paper position detection encoder 26, attitude detection sensors 27*a* and 27*b*, a paper arrival sensor 28, a paper position detection encoder 29 and attitude detection sensors 30*a* and 30*b*. These sensors are arranged above the transport unit 23. Each of the sensors detects the arrival of the paper P to the lower side of the sensor or the position of the edge of the paper P, and outputs the detection result to the controller 35.

The printing encoder 24 is provided at the same position in the paper transport direction as the printing head bar 31 and at the left side facing the paper transport direction. The printing encoder 24 is arranged at a position facing a position where the scale printed on the paper P passes. The printing encoder 24 detects the scale printed on the paper P passing the facing position and detects the transport amount of the paper P by the transport unit 23 based on the detection result. As the printing encoder 24, for example, the same sensor as the paper arrival sensors 9*a* to 9*c* may be used.

In the present embodiment, the scale printed on the paper P is detected and the transport amount of the paper P is detected based on the detection result. Accordingly, the rotary encoder does not need to be provided in order to detect the transport amount of the paper P and miniaturization and low cost of the device can be realized. Even when slippage is generated between the transport belt 7 and the paper P or when the transport speed of the paper P is changed, it is possible to accurately detect the transport amount of the paper P. In addition, even when expansion and contraction occurs in the paper P, it is possible to more accurately detect the position of the paper P.

The paper arrival sensor 25 is provided at the upstream side in the paper transport direction from the printing head bar 31 and at the left side when facing the paper transport direction. The paper arrival sensor 25 detects whether the paper P arrives at the lower side of the sensor or not. As the paper arrival sensor 25, for example, the same sensor as the paper arrival sensors 9*a* to 9*c* may be used.

The paper position detection encoder 26 is provided at the upstream side in the paper transport direction from the paper arrival sensor 25 and at the left side of the paper arrival sensor 25 when facing the paper transport direction. The paper position detection encoder 26 is arranged at a position facing a position where the scale printed on the paper P passes. The paper position detection encoder 26 detects the scale printed on the paper P passing the facing position and detects the transport amount of the paper P by the transport unit 23 based on the detection result. As the paper position detection encoder 26, for example, the same sensor as the printing encoder 24 may be used.

The attitude detection sensors 27*a* and 27*b* are provided at the upstream side in the paper transport direction from the paper arrival sensor 25 and at the left side of the paper arrival sensor 25 when facing the paper transport direction. The attitude detection sensors 27*a* and 27*b* are provided at positions facing positions where the target edges of the paper P pass. Each of the attitude detection sensors 27*a* and 27*b* is arranged in parallel along the paper transport direction. The arrangement order of the attitude detection sensors 27*a* and 27*b* is set to the order of 27*a* and 27*b* from the downstream side to the upstream side of the paper transport direction. The distance between adjacent position detection sensors 27*a* and 27*b* is the distance C. The distance between the attitude detection sensor 27*a* and the paper arrival sensor 25 in the paper transport direction is the distance A. Each of the attitude detection sensors 27*a* and 27*b* detects the positions of the target edges of the facing paper P. As the attitude detection sensors 27*a* and 27*b*, for example, the same sensor as the profile acquisition sensors 11*a* to 11*n* may be used.

The paper arrival sensor 28 is provided at the downstream side in the paper transport direction from the printing head bar 31 and at the left side when facing the paper transport direction. The paper arrival sensor 28 detects whether the paper P arrives at the lower side of the sensor or not. As the paper arrival sensor 28, for example, the same sensor as the paper arrival sensors 9*a* to 9*c* may be used.

The paper position detection encoder 29 is provided at the downstream side in the paper transport direction from the printing head bar 31, at the upstream side in the paper transport direction from the paper arrival sensor 28, and at the left side when facing the paper transport direction from the paper arrival sensor 28. The paper position detection encoder 29 is arranged at a position facing a position where the scale printed on the paper P passes. The paper position detection encoder 29 detects the scale printed on the paper P passing the facing position and detects the transport amount of the paper P by the transport unit 23 based on the detection result. As the paper position detection encoder 26, for example, the same sensor as the printing encoder 24 may be used.

The attitude detection sensors 30*a* and 30*b* are provided at the downstream side in the paper transport direction from the printing head bar 31, at the upstream side in the paper transport direction from the paper arrival sensor 28, and at the left side of the paper arrival sensor 28 when facing the paper transport direction. The attitude detection sensors 30*a* and 30*b* are provided at positions facing positions where the target edges of the paper P pass. Each of the attitude detection sensors 30*a* and 30*b* is arranged in parallel along the paper transport direction. The arrangement order of the attitude detection sensors 30*a* and 30*b* is set to the order of 30*a* and 30*b* from the downstream side to the upstream side of the paper transport direction. The distance between adjacent position detection sensors 30*a* and 30*b* is the distance C. The distance between the attitude detection sensor 30*a* and the paper arrival sensor 28 in the paper transport direction is the distance A. Each of the attitude detection sensors 30*a* and 30*b* detects the positions of the target edges of the facing paper P. As the attitude detection sensors 30*a* and 30*b*, for example, the same sensor as the profile acquisition sensors 11*a* to 11*n* may be used.

The on-paper mark printing unit 2 includes the printing head bar 31, a head movement motor 32 and a head rotation motor 33. These are arranged above the transport unit 23.

The printing head bar 31 is a line head extending in a direction orthogonal to the paper transport direction. The printing head bar 31 discharges an ink from a recording head 34 onto the paper P passing the lower side of the printing head bar 31 and prints an image to be printed, according to an instruction from the controller 35. The image to be printed is a printing target image which is printed on the paper P.

The head movement motor 32 is provided on an end of the printing head bar 31. The head movement motor 32 delivers power to a guide mechanism (not shown) according to an instruction from the controller 35 so as to displace the printing head bar 31 in a longitudinal direction.

The head rotation motor 33 is provided on an end of the printing head bar 31. The head rotation motor 33 delivers power to a rotation driving mechanism (not shown) according to an instruction from the controller 35 so as to rotate the printing head bar 31 in a horizontal plane.

The controller 35 is a microprocessor having an integrated circuit including an A/D conversion circuit, a D/A conversion circuit, a central calculation processing unit, a memory and the like. The controller 35 outputs an instruction for printing the scale on the arrived paper P to the printing head bar 19 according to a program stored in the memory, when the paper P arrives at the lower side of the printing head bar 19. In addition, the controller 35 outputs an instruction for printing the image to be printed on the arrived paper P to the printing head bar 31, when the paper P arrives at the lower side of the printing head bar 31.

The controller 35 executes a below-described attitude detection process based on the detection result output from the sensors according to a program stored in the memory.

Attitude Detection Process

Figure 3:
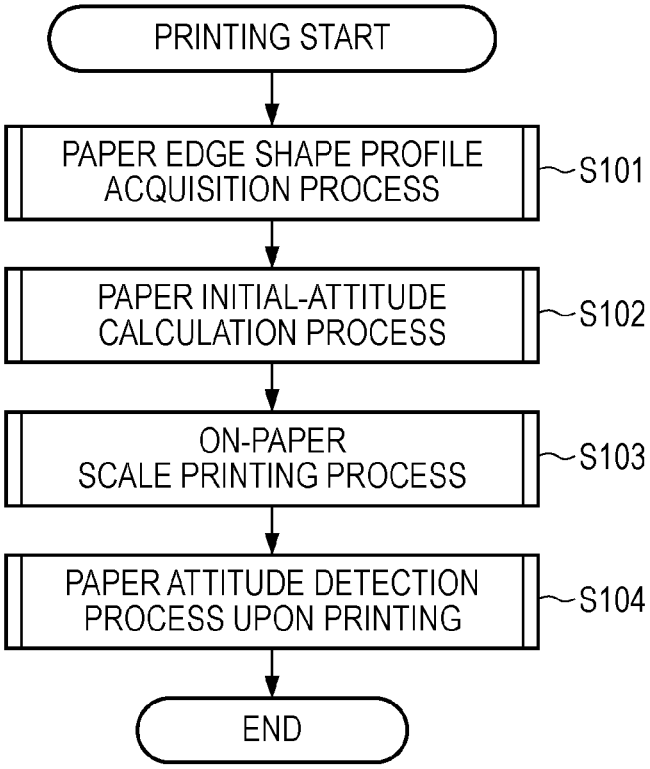
FIG. 3 is a flowchart illustrating an attitude detection process.

FIG. 3 is a flowchart illustrating a attitude detection process.

Next, the attitude detection process performed by the controller 35 will be described with reference to FIG. 3.

The process of FIG. 3 is the process of one piece of printing paper and is repeatedly executed with respect to every printing instruction from a print main controller (not shown).

As shown in FIG. 3, first, in step S101, the controller 35 executes a paper edge shape profile acquisition process. In the paper edge shape profile acquisition process, a plurality of positions of target edges in the direction orthogonal to the paper transport direction of the paper P is detected.

Subsequently, the process progresses to step S102, in which the controller 35 executes a paper initial-attitude calculation process. In the paper initial-attitude calculation process, the attitude of the paper P (for example, the position of the paper P, the slant of the paper P, or the like) at the time of detection of the plurality of positions is detected.

Subsequently, the process progresses to step S103, in which the controller 35 executes an on-paper scale printing process. In the on-paper scale printing process, first, two of the plurality of positions are detected at the time of printing the scale on the paper P. Subsequently, the slant of the paper P relative to the paper transport direction is calculated based on the result of detecting the plurality of positions and the result of detecting the two positions. Subsequently, at the time of printing the scale on the paper P, an instruction for displacing the printing head bar 19 in the longitudinal direction is output to the head movement motor 20. At the same time, an instruction for inclining the printing head bar 19 with respect to the direction orthogonal to the paper transport direction is output to the head rotation motor 21.

Accordingly, it is possible to control the printing position of the scale on the paper P. Thus, it is possible to print the scale on the paper P without relative displacement.

Subsequently, the process progresses to step S104, in which the controller 35 executes a paper attitude detection process at the time of printing. In the paper attitude detection process at the time of printing, first, two of the plurality of positions are detected at the time of printing the image to be printed on the paper P. Subsequently, the slant of the paper P relative to the paper transport direction is calculated based on the result of detecting the plurality of positions and the result of detecting the two positions. Subsequently, at the time of printing the image to be printed on the paper P, an instruction for displacing the printing head bar 31 in the longitudinal direction is output to the head movement motor 32. At the same time, an instruction for inclining the printing head bar 31 with respect to the direction orthogonal to the paper transport direction is output to the head rotation motor 33.

Accordingly, it is possible to control the printing position of the image to be printed on the paper P. Thus, it is possible to print the image to be printed on the paper P without relative displacement.

Figure 4:
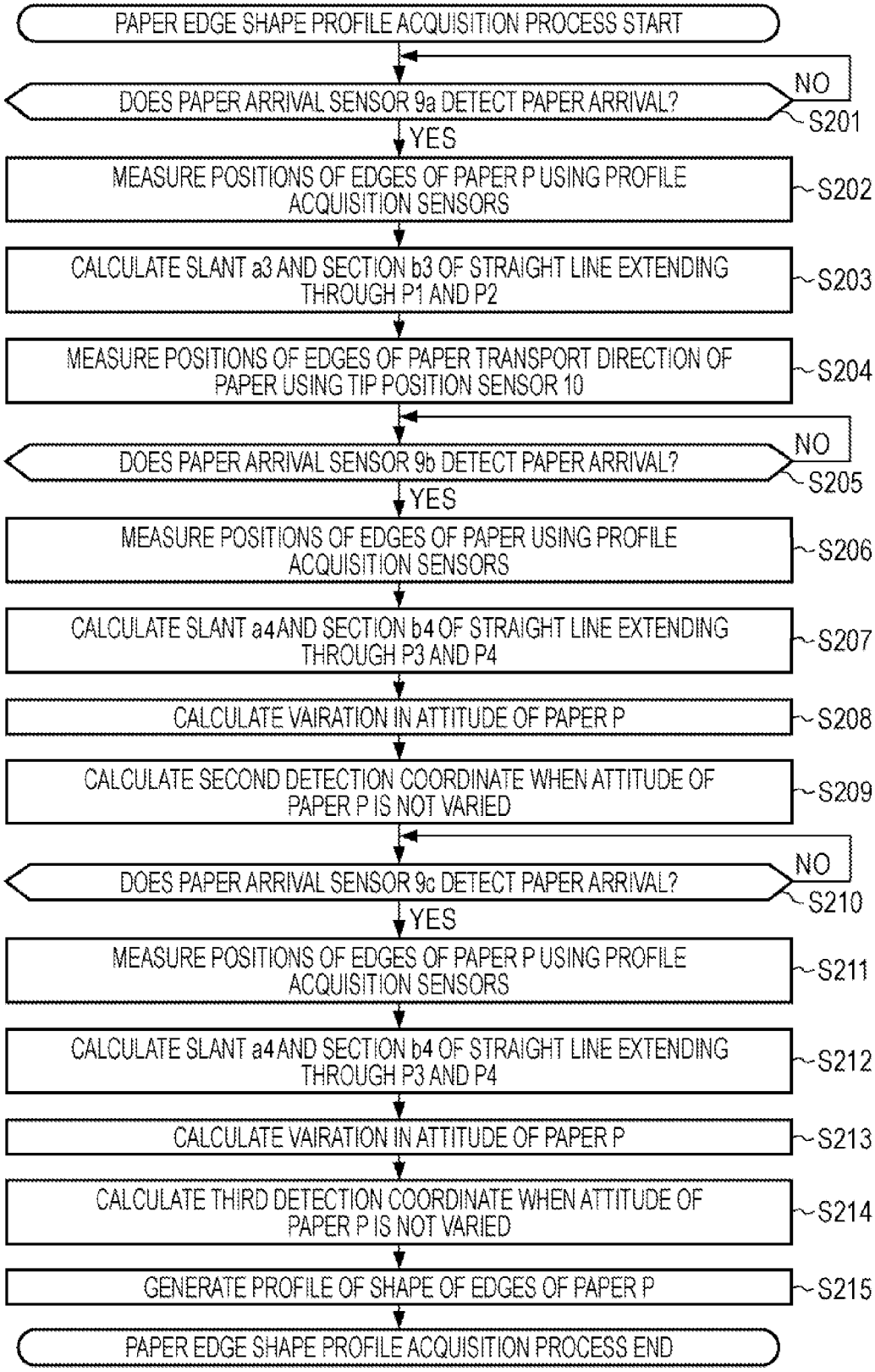
FIG. 4 is a flowchart illustrating a paper edge shape profile acquisition process.

FIG. 4 is a flowchart illustrating the paper edge shape profile acquisition process.

Next, the paper edge shape profile acquisition process performed by the controller 35 will be described with reference to FIG. 4.

As shown in FIG. 4, first, in step S201, the controller 35 determines whether the paper P arrives at the lower side of the paper arrival sensor 9*a* or not.

In detail, the controller 35 first acquires a detection result from the paper arrival sensor 9*a*. Subsequently, based on the acquired detection result, it is determined whether the paper P arrives at the lower side of the paper arrival sensor 9*a* or not. In addition, if it is determined that the paper P arrives at the lower side of the paper arrival sensor 9*a* (Yes), the process progresses to step S202. In contrast, if it is determined that the paper P does not arrive at the lower side of the paper arrival sensor 9*a* (No), this step is executed again.

FIG. 5 is a diagram explaining a method of detecting the positions of target edges of paper P.

Subsequently, the process progresses to step S202, in which the controller 35 detects the positions of the target edges of the paper P using each of the profile acquisition sensors 11*a* to 11*r*.

Figures 5A, 5B, 5C:
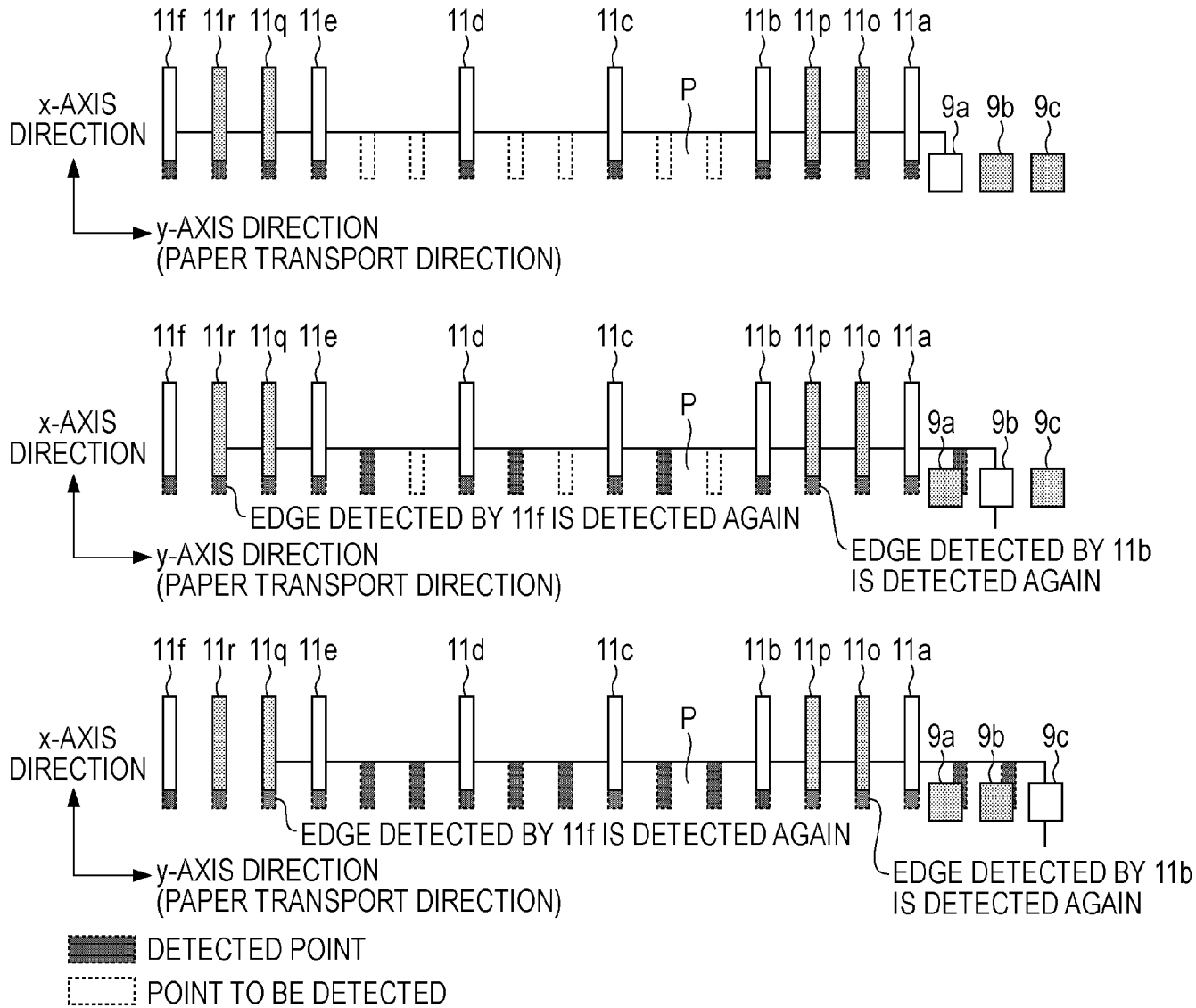
FIGS. 5A-5C are diagrams explaining a method of detecting the positions of target edges of paper.

In detail, as shown in FIG. 5A, the controller 35 first acquires the detection result from each of the profile acquisition sensors 11*a* to 11*r*. Subsequently, the acquired detection result is stored in a memory as a first detection coordinate.

Subsequently, the process progresses to step S203, in which the controller 35 sets the detection result output from the profile acquisition sensor 11*b* to P1(x3, y3) and the detection result output from the profile acquisition sensor 11*f* to P2(x4, y4). Subsequently, based on the set P1 and P2, a slant a3 and a section b3 are calculated by Equation 1. The slant a3 indicates a slant of a straight line extending through P1 and P2 in the xy coordinate system. The section b3 indicates a y coordinate of a point where a straight line extending through P1 and P2 crosses a y axis in the xy coordinate system.

$$y=a3x+b3$$

$$a3=(y4-y3)/(x4-x3),\ b3=y3-a3-x3 \quad (1)$$

Subsequently, the process progresses to step S204, in which the controller 35 detects the position of the edge of the paper transport direction of the paper P using the tip end position sensor 10.

In detail, the controller 35 first acquires the detection result from the tip end position sensor 10. Subsequently the acquired detection result is stored in the memory as a first tip end position sensor detection value.

Subsequently, the process progresses to step S205, in which the controller 35 determines whether the paper P arrives at the lower side of the paper arrival sensor 9*b* or not.

In detail, first, the controller 35 acquires a detection result from the paper arrival sensor 9*b*. Subsequently, based on the acquired detection result, it is determined whether the paper P arrives at the lower side of the paper arrival sensor 9*b* or not. In addition, if it is determined that the paper P arrives at the lower side of the paper arrival sensor 9*b* (Yes), the process progresses to step S201. In contrast, if it is determined that the paper P does not arrive at the lower side of the paper arrival sensor 9*b* (No), this step is executed again.

Subsequently, the process progresses to step S206, in which the controller 35 detects the positions of the target edges of the paper P using each of the profile acquisition sensors 11*a* to 11*r*.

In detail, as shown in FIG. 5B, first, the controller 35 acquires the detection result from each of the profile acquisition sensors 11*a* to 11*r*. Subsequently, the acquired detection result is stored in the memory as a second detection coordinate.

By this operation, the positions of the locations detected by the profile acquisition sensors 11*b* and 11*f* at the time of the detection of the first detection coordinate are detected by the profile acquisition sensors 11*p* and 11*r* again.

Subsequently, the process progresses to step S207, in which the controller 35 sets the detection result output from the profile acquisition sensor 11*p* to P3(x5, y5) and the detection result output from the profile acquisition sensor 11*r* to P4(x6, y6). Subsequently, based on the set P3 and P4, a slant a4 and a section b4 are calculated by Equation 2. The slant a4 indicates a slant of a straight line extending through P3 and P4 in the xy coordinate system. The section b4 indicates a y coordinate of a point where a straight line extending through P3 and P4 crosses a y axis in the xy coordinate system.

$$y=a4x+b4$$

$$a4=(y6-y5)/(x6-x5),\ b4=y5-a5\cdot x5 \quad (2)$$

Subsequently, the progress progresses to step S208, in which the controller 35 calculates a variation in attitude of the paper P from a time when the first detection coordinate is detected to a time when the second detection coordinate is detected.

In detail, first, the controller 35 calculates a crossing coordinate (Cx, Cy) and a variation angle $\theta_{(2-1)}$ by Equations 3 to 5, based on a3 and b3 calculated in step S203 and a4 and b4 calculated in step S207. The crossing coordinate (Cx, Cy) indicates a coordinate of an intersection point between the straight line extending through P1 and P2 and the straight line extending through P3 and P2. The variation angle $\theta_{(2-1)}$ is an angle between the straight line extending through P1 and P2 and the straight line extending through P3 and P2.

$$Cx=(b4-b3)/(a3-a4) \quad (3)$$

$$Cy=(a4\times b3-a3\times b4)/(a4-a3) \quad (4)$$

$$\theta_{(2-1)}=\theta_2-\theta_1$$

$$\theta_1=\tan^{-1}((x3-Cx)/(y3-Cy))$$

$$\theta_2=\tan^{-1}((x4-Cx)/(y4-Cy)) \quad (5)$$

Subsequently, the process progresses to step S209, in which the controller 35 calculates a corrected second detection coordinate. The corrected second detection coordinate indicates a coordinate obtained by eliminating, from the second detection coordinate, a paper attitude variation (paper position, paper angle, or the like) component from the time when the first coordinate is detected to the time when the second coordinate is detected.

In detail, the controller 35 first reads the second detection coordinate from the memory. Subsequently, based on each coordinate value (x, y) of the read second detection coordinate, each coordinate value (x', y') of the corrected second detection coordinate is calculated by Equations 6 and 7.

$$x'=(x-Cx)\times\cos\theta_{(2-1)}-(y-Cy)\times\sin\theta_{(2-1)}+Cx \quad (6)$$

$$y'=(x-Cx)\times\sin\theta_{(2-1)}+(y-Cy)\times\cos\theta_{(2-1)}+Cy \quad (7)$$

By this operation, even when the attitude of the paper P is varied from the time when the first detection coordinate is detected to the time when the second detection coordinate is detected, it is possible to eliminate influence of the attitude variation of the paper P from the second coordinate.

In the present embodiment, the positions of the locations detected by the profile acquisition sensors 11*b* and 11*f* was detected by the profile acquisition sensors 11*p* and 11*r* again. The variation in attitude of the paper P was determined based on the detection result and the second detection coordinate detected by the profile acquisition sensors 11*a* to 11*n* was corrected based on the determination result. Accordingly, even when the attitude of the paper P is varied from the time when the first detection coordinate is detected to the time when the second detection coordinate is detected, it is possible to acquire an adequate second detection coordinate.

Subsequently, the controller 35 stores the corrected second detection coordinate in the memory.

Subsequently, the process progresses to step S210, in which the controller 35 determines whether the paper P arrives at the lower side of the paper arrival sensor 9*c*.

In detail, first, the controller 35 acquires a detection result from the paper arrival sensor 9*c*. Subsequently, based on the acquired detection result, it is determined whether the paper P arrives at the lower side of the paper arrival sensor 9*c*. In addition, if it is determined that the paper P arrives at the lower side of the paper arrival sensor 9*c* (Yes), the process progresses to step S211. In contrast, if it is determined that the paper P does not arrive at the lower side of the paper arrival sensor 9*c* (No), this step is executed again.

In step S211, the positions of the target edges of the paper P are detected by each of the profile acquisition sensors 11*a* to 11*r*.

In detail, as shown in FIG. 5C, the controller 35 first acquires the detection result from the profile acquisition sensors 11*a* to 11*r*. Subsequently, the acquired detection result is stored in the memory as a third detection coordinate.

By this configuration, the positions of the locations detected by the profile acquisition sensors 11*b* and 11*f* at the time of the detection of the first detection coordinate is detected by the profile acquisition sensors 110 and 11*q* again.

Subsequently, the process progresses to step S212, in which the controller 35 first sets the detection result output from the profile acquisition sensor 110 to P3(x5, y5) and the detection result output from the profile acquisition sensor 11*q* to P4(x6, y6). Subsequently, based on the set P3 and P4, a slant a4 and a section b4 are calculated by Equation 2.

Subsequently, the process progresses to step S213, in which the controller 35 calculates a variation in slant of the paper P relative to the paper transport direction from the time when the first detection coordinate is detected to the time when the third detection coordinate is detected.

In detail, the controller 35 first calculates a crossing coordinate (Cx, Cy) and a variation angle $\theta_{(3-1)}$ by Equations 8 to 10, based on a3 and b3 calculated in step S203 and a4 and b4 calculated in step S212.

$$Cx=(b4-b3)/(a3-a4) \tag{8}$$

$$Cy=(a4\times b3-a3\times b4)/(a4-a3) \tag{9}$$

$$\theta_{(3-1)}=\theta_3-\theta_1$$

$$\theta_1=\tan^{-1}((x3-Cx)/(y3-Cy))$$

$$\theta_3=\tan^{-1}((x4-Cx)/(y4-Cy)) \tag{10}$$

Subsequently, the process progresses to step S214, in which the controller 35 calculates a corrected third detection coordinate. The corrected third detection coordinate indicates a coordinate obtained by eliminating a paper attitude variation (paper position, paper angle, or the like) component from the time when the first coordinate is detected to the time when the third coordinate is detected, from the third detection coordinate.

In detail, the controller 35 first reads the third detection coordinate from the memory. Subsequently, based on each coordinate value (x, y) of the read third detection coordinate, each coordinate value (x', y') of the corrected third detection coordinate is calculated by Equations 11 and 12.

$$x'=(x-Cx)\times\cos\theta_{(3-1)}-(y-Cy)\times\sin\theta_{(3-1)}+Cx \tag{11}$$

$$y'=(x-Cx)\times\sin\theta_{(3-1)}+(y-Cy)\times\cos\theta_{(3-1)}+Cy \tag{12}$$

By this operation, even when the attitude of the paper P is varied from the time when the first detection coordinate is detected to the time when the third detection coordinate is detected, it is possible to eliminate influence of the attitude variation of the paper P from the third coordinate.

In the present embodiment, the positions of the locations detected by the profile acquisition sensors 11*b* and 11*f* were detected by the profile acquisition sensors 110 and 11*q* again. The variation in attitude of the paper P was determined based on the detection result and the third detection coordinate detected by the profile acquisition sensors 11*a* to 11*n* was corrected based on the determination result. Accordingly, even when the attitude of the paper P is varied from the time when the first detection coordinate is detected to the time when the third detection coordinate is detected, it is possible to acquire an adequate third detection coordinate.

Figure 6:
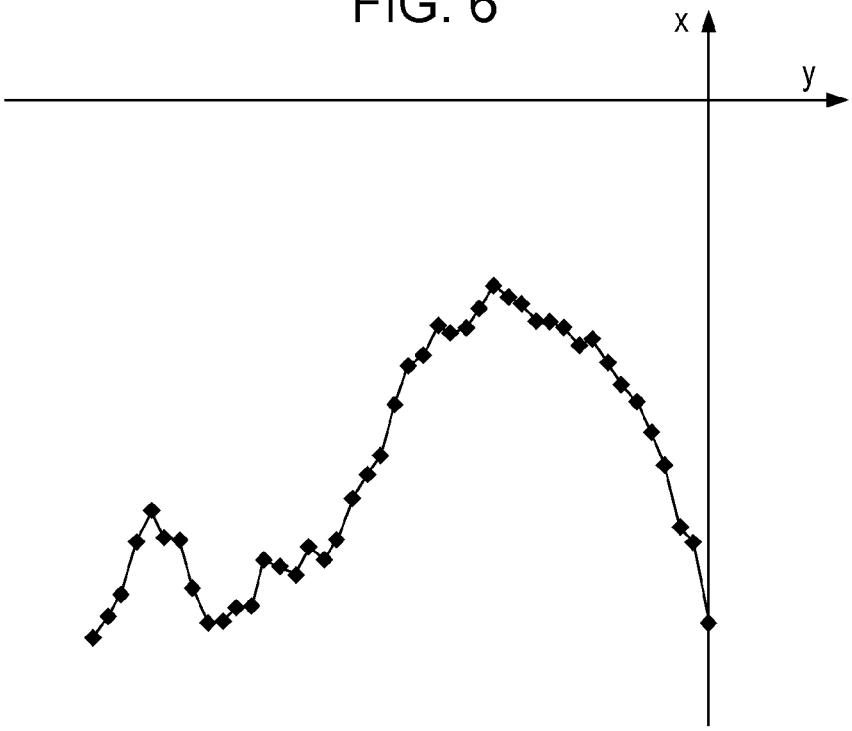
FIG. 6 is a diagram showing a profile.

FIG. 6 is a diagram showing a profile.

Subsequently, the process progress to step S215, in which the controller 35 acquires a profile indicating the shape of the edge of the longitudinal direction of the paper P.

In detail, the controller 35 reads the first detection coordinate, the corrected second detection coordinate and the corrected third detection coordinate from the memory. Subsequently, the read first detection coordinate, that obtained by subtracting the distance A from the y component of each coordinate value of the corrected second detection coordinate, and that obtained by subtracting the distance 2A from the y component of each coordinate value of the corrected third detection coordinate are synthesized. Subsequently, as shown in FIG. 6, the synthesized result is stored in the memory as the profile.

In the present embodiment, the profile acquisition sensors 11*a* to 11*n* was arranged in parallel in the paper transport direction. Accordingly, it is possible to easily detect the positions of the target edges of the paper P.

In the present embodiment, the profile acquisition sensors 11*a* to 11*n* were arranged at an interval of the distance 3A. Whenever the paper P is transported by the distance A, the positions of the target edges of the paper P were detected by each of the profile acquisition sensors 11*a* to 11*n*, the detection results are synthesized, and the positions of the target edges of the paper P were acquired. Accordingly, it is possible to reduce the number of profile acquisition sensors 11*a* to 11*n* necessary for detecting the positions of the target edges.

Figure 7:
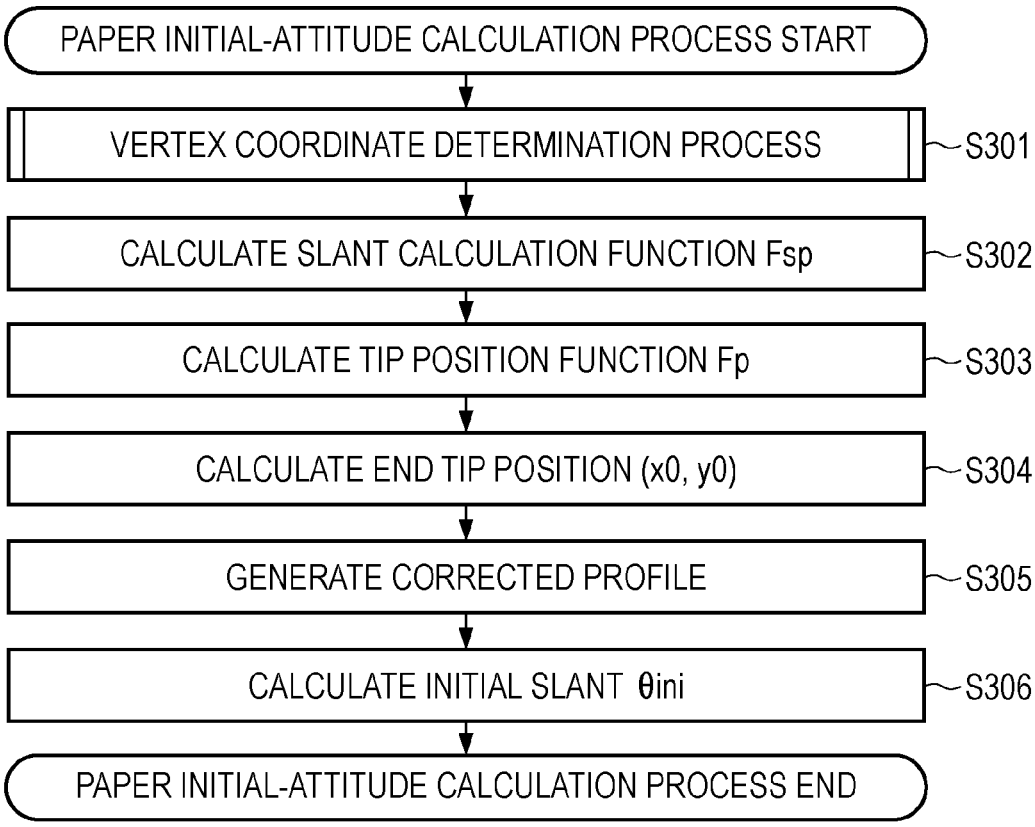
FIG. 7 is a flowchart illustrating a paper initial-attitude calculation process.

FIG. 7 is a flowchart illustrating a paper initial-attitude calculation process.

Next, the paper initial-attitude calculation process performed by the controller 35 will be described with reference to FIG. 7.

As shown in FIG. 7, first, in step S301, the controller 35 executes the below-described vertex coordinate determination process. In the vertex coordinate determination process, two vertex coordinates (x1, y1) and (x2, y2) are selected from the profile acquired by the paper edge shape profile acquisition process. The vertex coordinates (x1, y1) and (x2, y2) are coordinates of most protruding portions of the target edges of the paper P.

Figure 8:
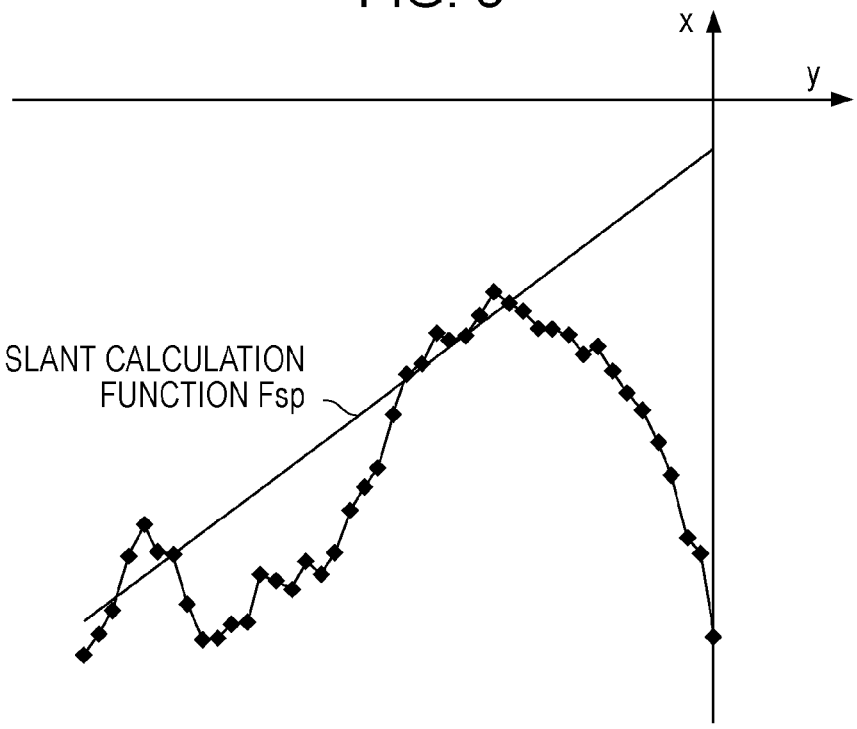
FIG. 8 is a diagram showing a slant calculation function.

FIG. 8 is a diagram showing a slant calculation function Fsp.

Subsequently, the process progresses to step S302, in which the controller 35 determines the attitude of the paper P relative to the paper transport direction.

In detail, the controller 35 calculates a slant calculation function Fsp by Equation 13 based on the vertex coordinates (x1, y1) and (x2, y2) selected in step S301. The slant calculation function Fsp is a linear function indicating a straight line extending through the vertex coordinates (x1, y1) and (x2, y2) and indicates the slant of the paper P relative to the paper transport direction, as shown in FIG. 8.

$$Fsp=y=a1\cdot x+b1$$

$$a1=(y2-y1)/(x2-x1),\ b1=y1-a1\cdot x1 \quad (13)$$

Figure 9:
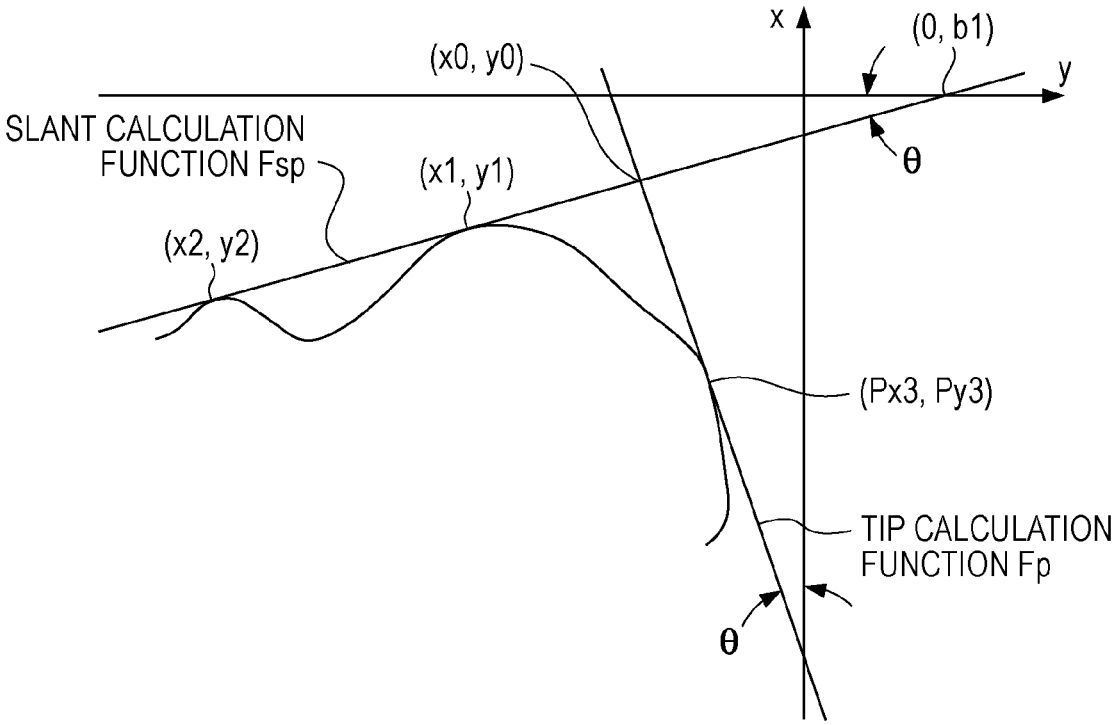
FIG. 9 is a diagram showing a tip position function.

FIG. 9 is a diagram showing a tip position function Ftp.

Subsequently, the process progresses to step S303, in which the controller 35 reads a first tip position sensor detection value from the memory. Based on the read first tip position sensor detection value, the tip position function Ftp is calculated by Equation 14. The tip position function Ftp is a temporal function indicating a straight line which passes a coordinate indicated by the first tip position sensor detection value and is orthogonal to the slant calculation function Fsp, as shown in FIG. 9.

$$Ftp=y=a2\cdot x+b2 \quad (14)$$

Subsequently, the process progresses to step S304, in which the controller 35 calculates an intersection point between Fsp and Ftp based on the slant calculation function Fsp calculated in step S302 and the tip position function Ftp calculated in step S303. Subsequently, the calculated intersection point is set to an end tip position (x0, y0).

Subsequently, the process progresses to step S305, in which the controller 35 first reads the profile indicating the shape of the target edges of the paper P from the memory. Subsequently, the y component y0 of the end tip position edge (x0, y0) is subtracted from the y component of each of the coordinate values of the read profile. Subsequently, the coordinate values obtained by subtraction are stored in the memory as a completely corrected profile.

By this operation, it is possible to obtain a corrected profile in which the position of y0 is set to the original point of the y axis, that is, y=0, in the y component of the profile.

Subsequently, the process progresses to step S306, in which the controller 35 calculates an initial slant θini by Equation 15 based on the slant a1 calculated in step S302. The initial slant θini indicates an angle indicating the slant of the slant calculation function Fsp relative to the paper transport direction.

$$\theta ini=\tan-1(-1/a1) \quad (15)$$

Figure 10:
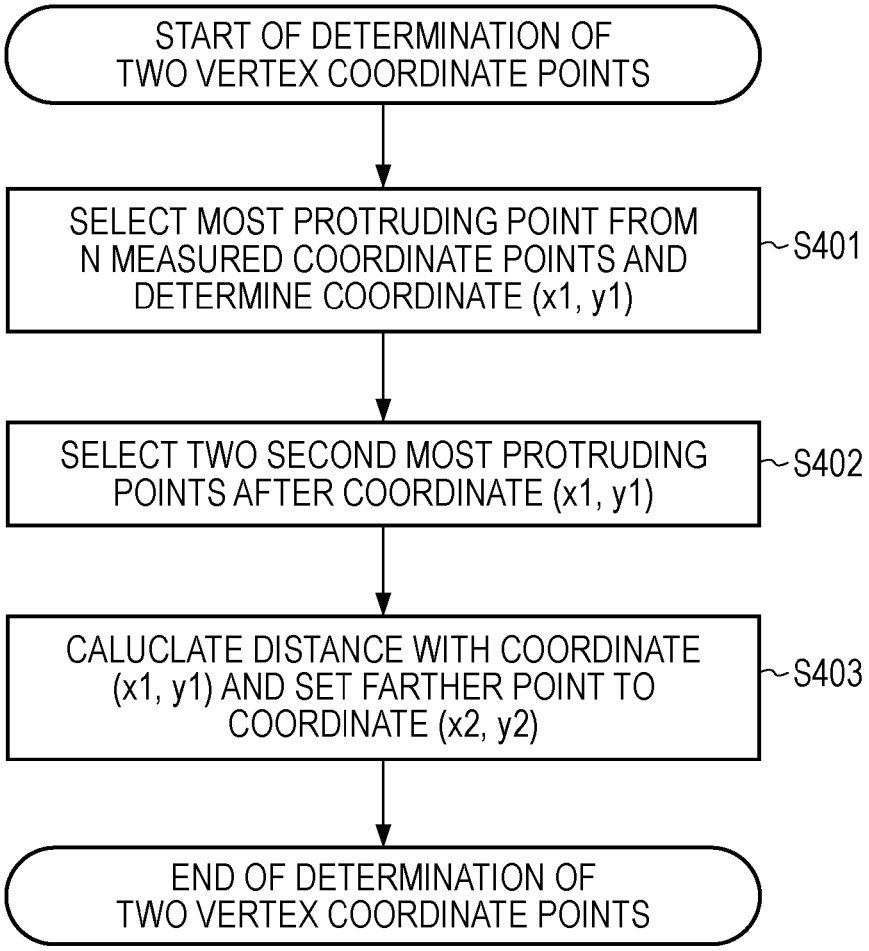
FIG. 10 is a flowchart illustrating a vertex coordinate determination process.

FIG. 10 is a flowchart illustrating the vertex coordinate determination process.

Next, the vertex coordinate determination process performed by the controller 35 will be described with reference to FIG. 10.

As shown in FIG. 10, in step S401, the controller 35 first reads the profile from the memory. Subsequently, the coordinate of a most protruding portion of the target edges of the paper P is selected from the read profile. Subsequently, the selected coordinate is set to a vertex coordinate (x1, y1).

Subsequently, the process progresses to step S402, in which the controller 35 first reads the profile from the memory. Subsequently, the coordinate of a second most protruding portion and the coordinate of a second most protruding portion of the target edges of the paper P are selected from the read profile.

Subsequently, the process progresses to step S403, in which the controller 35 first selects a point located farther from the coordinate (x1, y1) selected in step S401 from the two coordinates selected in step S402. Subsequently, the selected coordinate is set to the vertex coordinate (x2, y2). Subsequently, this arithmetic process is finished to progress to step S301 of the original paper initial-attitude calculation process. Since a distance from a most protruding portion as well as a protrusion degree from the paper P is considered, attitude determination considering the center of the paper P is possible.

Figures 11, 11A:
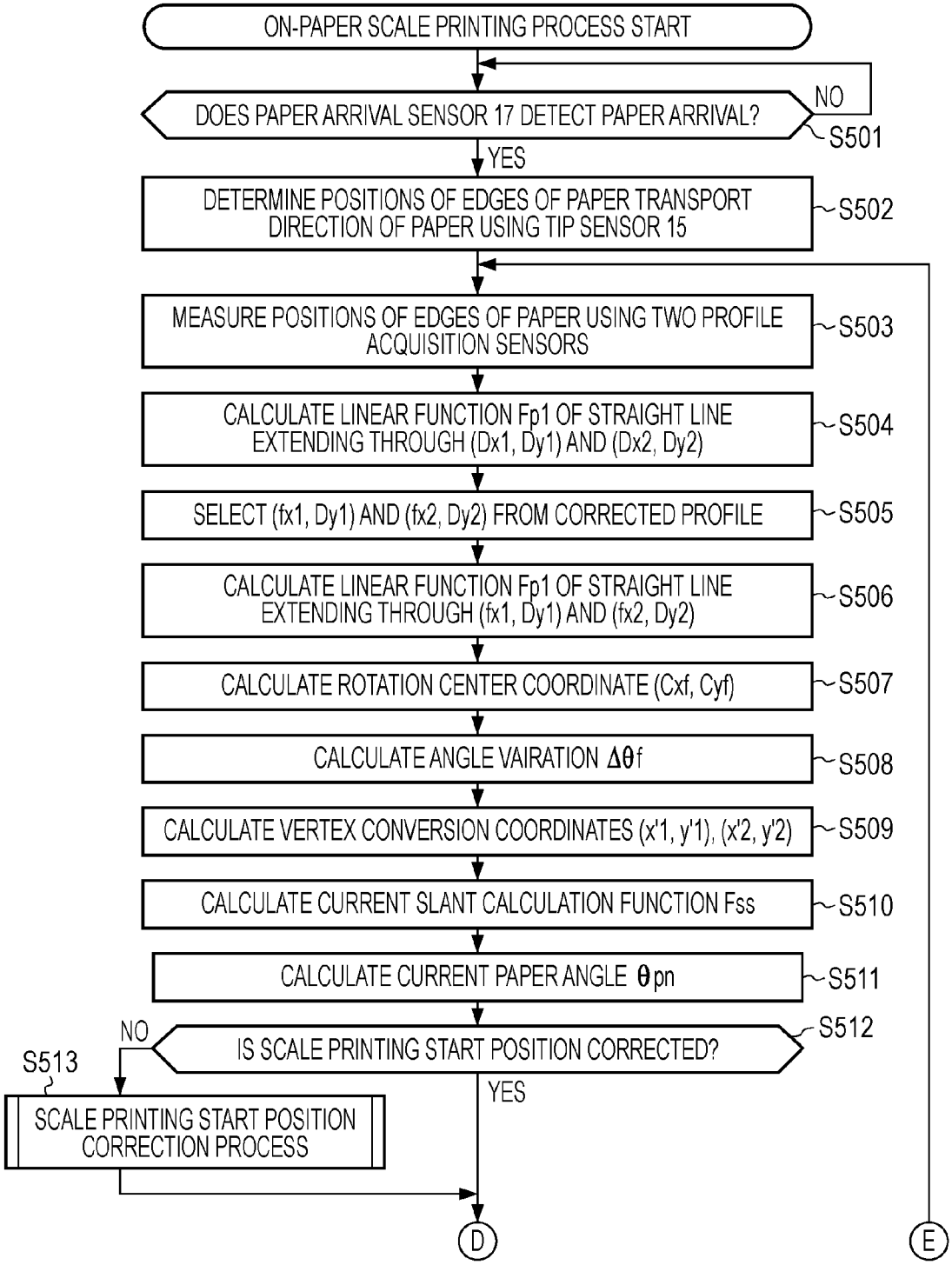
FIG. 11, including
FIGS. 11A and 11B, is a flowchart illustrating an on-paper scale printing process on paper.
Figure 11B:
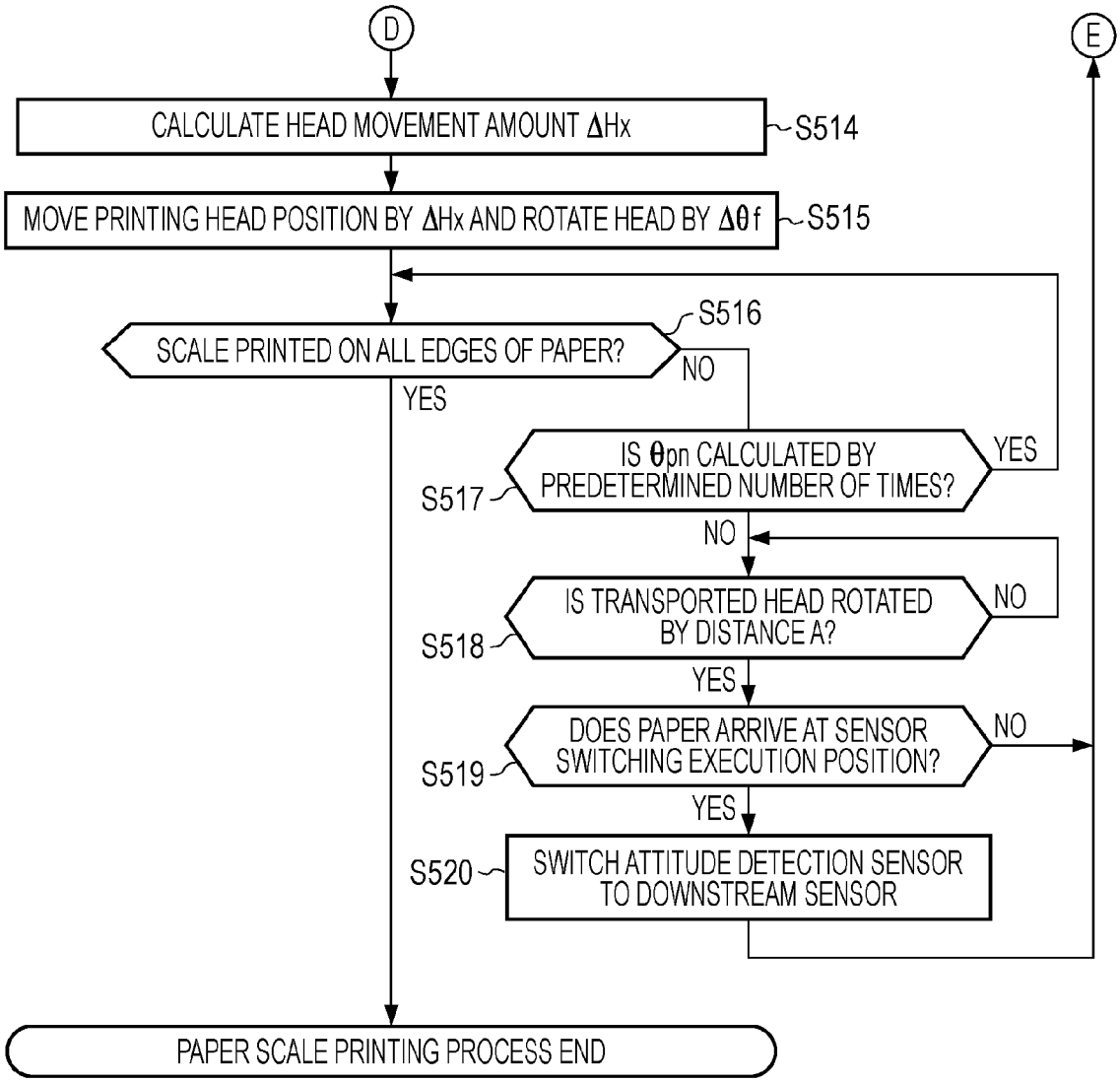

FIG. 11 is a flowchart illustrating an on-paper scale printing process on paper.

Next, the on-paper scale printing process performed by the controller 35 will be described with reference to FIG. 11.

As shown in FIG. 11, in step S501, the controller 35 determines whether the paper P arrives at the lower side of the paper arrival sensor 14 or not.

In detail, the controller 35 first acquires the detection result from the paper arrival sensor 14. Subsequently, based on the acquired detection result, it is determined whether the paper P arrives at the lower side of the paper arrival sensor 14. In addition, if it is determined that the paper P arrives at the lower side of the paper arrival sensor 14 (Yes), the process progresses to step S502. In contrast, if it is determined that the paper P does not arrive at the lower side of the paper arrival sensor 14 (No), this step is executed again.

Subsequently, the process progresses to step S502, in which the controller 35 detects the positions of the edges of the paper transport direction of the paper P using the tip position sensor 15.

In detail, the controller 35 first acquires the detection result from the tip position sensor 15. Subsequently, the acquired detection result is stored in the memory as a second tip position sensor detection value (Px4, Py4).

FIG. 12 is a diagram explaining a method of calculating a variation amount of attitude of paper P.

Subsequently, the process progresses to step S503, in which the controller 35 detects the positions of the target edges of the paper P using each of the attitude detection sensors 16*a* and 16*b*.

Figure 12A:
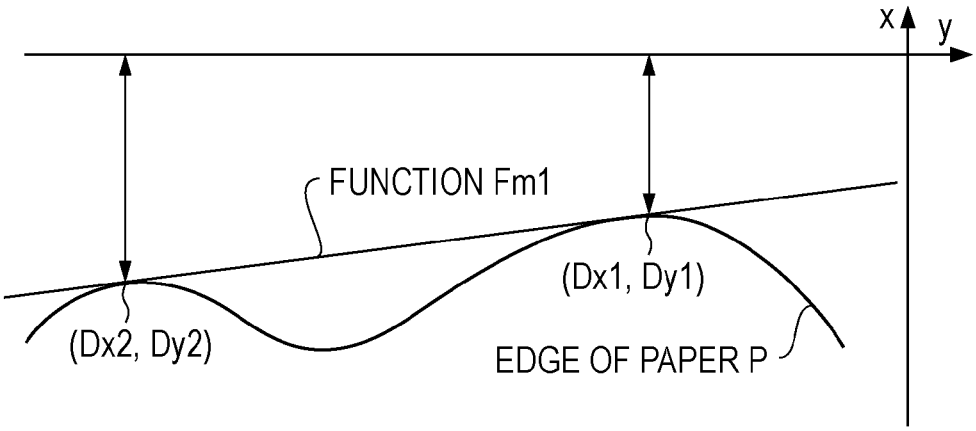
FIGS. 12A-12C are diagrams explaining a method of calculating a variation amount variation in attitude of paper P.

In detail, as shown in FIG. 12A, the controller 35 first acquires the detection result from each of the attitude detection sensors 16*a* and 16*b*. Subsequently, the y component of the coordinate value of the paper arrival sensor 14 is subtracted from the y component of the coordinate value which is the detection result acquired from the attitude detection sensor 16*a* and a distance A×i is subtracted. Here, i denotes a value indicating the number of times of execution of this step after this arithmetic process begins. Subsequently, the coordinate obtained by subtraction is set to (Dx1, Dy1). Subsequently, the y component of the coordinate value of the paper arrival sensor 14 is subtracted from the y component of the coordinate value which is the detection result acquired from the attitude detection sensor 16*b* and a distance A×(i+3) is subtracted. Subsequently, the coordinate obtained by subtraction is set to (Dx2, Dy2).

Subsequently, the process progresses to step S504, in which the controller 35 calculates a function Fm1 by Equation 16 based on the (Dx1, Dy1) and (Dx2, Dy2) acquired in step S503. The function Fm1 is a linear function indicating a straight line extending through (Dx1, Dy1) and (Dx2, Dy2).

$$Fm1=y=a3x+b3 \tag{16}$$

$$a3=(Dy2-Dy1)/(Dx2-Dx1),\ b3=Dy1-a3\cdot Dx1$$

Figure 12B:
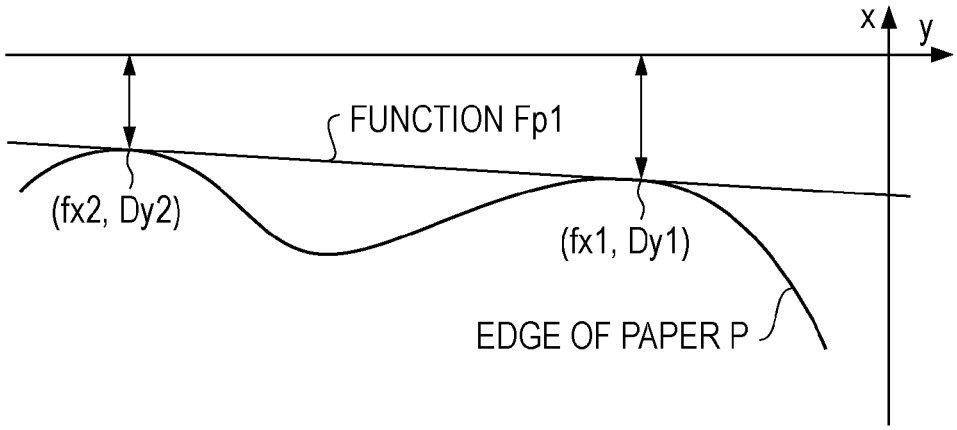

Subsequently, the process progresses to step S505, in which the controller 35 first reads a corrected profile from the memory. Subsequently, as shown in FIG. 12B, a coordinate (fx1, Dy1) having a y component of Dy1 and a coordinate (fx2, Dy2) having a y component of Dy2 are selected from the read corrected profile.

Subsequently, the process progresses to step S506, in which the controller 35 calculates a function Fp1 by Equation 17 based on the coordinates (fx1, Dy1) and (fx2, Dy2) selected in step S505. The function Fp1 is a linear function indicating a straight line extending through (fx1, Dy1) and (fx2, Dy2).

$$Fp1=y=a3x+b3$$

$$a3=(Dy2-Dy1)/(fx2-fx1),\ b3=Dy1-a3\cdot fx1 \tag{17}$$

Subsequently, the process progresses to step S507, in which the controller 35 calculates a rotation center coordinate (Cxf, Cyf) in the variation in attitude of the paper P.

Figure 12C:
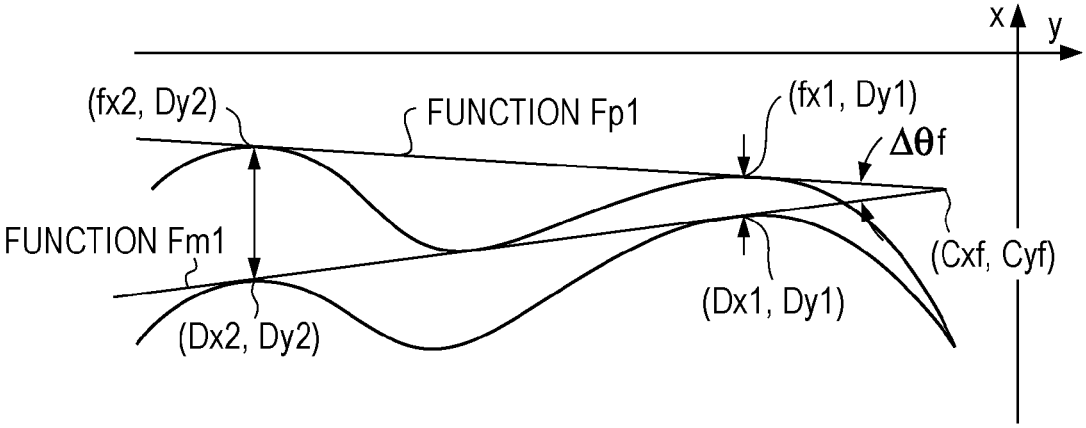

In detail, the controller 35 calculates the rotation center coordinate (Cxf, Cyf) by Equations 18 and 19 based on a3, a4, b3 and b4 calculated in steps S504 and S506. The rotation center coordinate (Cxf, Cyf) indicates the coordinate of an intersection point between a straight line extending through (Dx1, Dy1) and (Dx2, Dy2) and a straight line extending through (fx1, Dy1) and (fx2, Dy2), as shown in FIG. 12C.

$$Cxf=(b4-b3)/(a3-a4) \tag{18}$$

$$Cyf=(a4\times b3-a3\times b4)/(a4-a3) \tag{19}$$

Subsequently, the process progresses to step S508, in which the controller 35 calculates the variation amount of attitude of the paper P from the time when the profile is acquired to the time when the coordinates (Dx1, Dy1) and (Dx2, Dy2) are acquired.

In detail, the controller 35 calculates an angle variation amount Δθf by Equation 20 based on the rotation center coordinate (Cxf, Cyf) calculated in step S507. The angle variation amount Δθf indicates an angle between a straight line extending through P1 and P2 and a straight line extending through P3 and P2.

$$\Delta\theta f=\theta_2-\theta_1$$

$$\theta_1=\tan^{-1}((Dx1-Cfx)/(Dy1-Cfy))$$

$$\theta_2=\tan^{-1}((Dx2-Cfx)/(Dy2-Cfy)) \tag{20}$$

Subsequently, the process progresses to step S509, in which the controller 35 calculates vertex conversion coordinates (x'1, y'1) and (x'2, y'2) by Equation 21 based on the rotation center coordinate (Cxf, Cyf) calculated in step S507 and the angle variation amount Δθf calculated in step S508. The vertex conversion coordinates (x'1, y'1) and (x'2, y'2) denote coordinates when the vertex coordinates (x1, y1) and (x2, y2) are rotated around the rotation center coordinate (Cxf, Cyf) by the angle variation amount Δθf.

$$x'1=(x1-Cxf)\times\cos\Delta\theta f-(y1-Cyf)\times\sin\Delta\theta f+Cx \tag{21}$$

$$y'1=(x1-Cxf)\times\sin\Delta\theta f+(y1-Cyf)\times\cos\Delta\theta f+Cy \tag{22}$$

Subsequently, the process progresses to step S510, in which the controller 35 determines the attitude of the paper P relative to the paper transport direction.

In detail, a slant calculation function Fss is calculated by Equation 23 based on the vertex conversion coordinates (x'1, y'1) and (x'2, y'2) calculated in step S509. The slant calculation function Fss denotes a linear function indicating a straight line extending through the vertex conversion coordinates (x'1, y'1) and (x'2, y'2).

$$Fss=y=a1\cdot x+b1$$

$$a1=(y'2-y'1)/(x'2-x'1),\ b1=y'1-a1\cdot x'1 \tag{23}$$

Subsequently, the process progresses to step S511, in which the controller 35 determines the attitude of the paper P.

In detail, the controller 35 calculates a paper angle θpn indicating the attitude of the paper P by Equation 24 based on a1 calculated in step S510. The paper angle θpn indicates an angle indicating the slant of the slant calculation function Fss relative to the paper transport direction.

$$\theta pn=\tan-1(-1/a1) \tag{24}$$

In the present embodiment, the attitude of the paper P was determined based on the corrected profile indicating the shape of the target edges of the paper P and the positions of the target edges detected by the attitude detection sensors 16*a* and 16*b*. Therefore, it is possible to determine the attitude of the paper P in consideration of the shape of the target edges of the paper P. Thus, since printing on the paper P is performed by inclining the scale with respect to the transport direction of the paper P based on the attitude of the paper P, it is possible to print the scale on the paper P without relative displacement, even when irregularities are present in the target edges of the paper P.

Subsequently, the process progresses to Step S512, in which the controller 35 determines whether a scale printing start position correction process is executed or not after this arithmetic process begins. The scale printing start position correction process indicates a process of correcting a head position coordinate Hy indicating the position of the paper transport direction of the printing head bar 19. In addition, if it is determined that the scale printing start position correction process is executed (Yes), the process progresses to step S514. In contrast, if it is determined that the scale printing start position correction process is not executed (No), the process progresses to step S513.

In the step S513, the controller 35 executes the scale printing start position correction process and then the process progresses to step S514.

In step S514, the controller 35 first calculates a head destination coordinate Hx by Equation 25 based on the slant calculation function Fss calculated in step S510. The head destination coordinate Hx indicates the x component of the coordinate of the destination of the printing head bar 19.

$$Hx=(Hy-b1)/a1 \tag{25}$$

Subsequently, the controller 35 calculates a head movement amount ΔHx by Equation 26 based on the calculated head destination coordinate Hx. The head movement amount ΔHx indicates a difference between the head destination coordinate Hx and the x component of the coordinate of the current position of the printing head bar 19.

$$\Delta Hx=Hx-Hxold \tag{26}$$

Here, Hxold denotes a value of Hx calculated when this step is executed the last time. In addition, when this step is initially executed, "0" is used as Hxold.

Subsequently, the process progresses to step S515, in which the controller 35 performs printing on the paper P by inclining the scale relative to the paper transport direction.

In detail, the controller 35 first outputs a command for moving the printing head bar 19 by the head movement amount ΔHx in the direction orthogonal to the paper transport direction to the head movement motor 20. Subsequently, a command for rotating the printing head bar 19 using the end of the printing head bar 19 as the rotation center by the angle variation amount Δθf in the horizontal plane is output to the head rotation motor 21.

By this operation, it is possible to print the scale at an adequate position on the paper P.

The calculation of the head movement amount ΔHx and the movement of the printing head bar 19 are repeatedly executed during the printing of the scale. Thus, even when the attitude of the paper P is varied during the printing of the scale, it is possible to print the scale on the paper P without relative displacement.

Subsequently, the process progresses to step S516, in which the controller 35 determines whether or not the printing head bar 19 prints the scale on all the vicinities of the left edges of the paper P when facing the transport direction. When it is determined that the scale is printed on all the vicinities of the edges (Yes), this arithmetic process is finished and the process progresses to step S104 of the original printing start process. In contrast, if it is determined that the scale is not printed on all the vicinities of the edges (No), the process progresses to step S518.

In step S517, the controller 35 determines whether the calculation of the paper angle θpn is performed by a predetermined number of times or not. As the predetermined number of times, for example, the number of coordinate points configuring the profile may be used.

In detail, the controller 35 determines whether or not the number of times of execution of step S511 is greater than or equal to the predetermined number of times after this arithmetic process begins. If it is determined that the number of times of execution of step S511 is greater than or equal to the predetermined number of times (Yes), the process progresses to step S516. In contrast, if it is determined that the number of times of execution of step S511 is less than the predetermined number of times (No), the process progresses to step S518.

In step S518, the controller 35 determines whether the paper P is transported by the distance A or not.

In detail, the controller 35 first acquires the detection result from the rotary encoder 13. Subsequently, based on the acquired detection result, it is determined whether or not the transport belt 7 of the transport unit 12 is rotated by the distance A in the paper transport direction after step S503 is executed. It is determined that the transport belt 7 is rotated by the distance A in the paper transport direction (Yes), it is determined that the paper P is transported by the distance A and the process progresses to step S519. In contrast, if it is determined that the transport belt 7 is not rotated by the distance A in the paper transport direction (No), this step is executed again.

In step S519, the controller 35 acquires the detection result from the rotary encoder 13. Subsequently, based on the acquired detection result, it is determined whether or not the paper P arrives at a sensor switching execution position. The sensor switching execution position indicates a position where the positions of the edges of the longitudinal direction of the paper P cannot be detected by the attitude detection sensors 16*a* and 16*b*. If it is determined that the paper P arrives at the sensor switching execution position (Yes), the process progresses to step S520. In contrast, if it is determined that the paper P does not arrive at the sensor switching execution position (No), the process progresses to step S503.

In step S520, the controller 35 switches the sensor used in step S503 from the attitude detection sensors 16*a* and 16*b* to the attitude detection sensor 18*a* and the attitude detection sensor 18*b* and then the process progresses to step S503.

Figure 13:
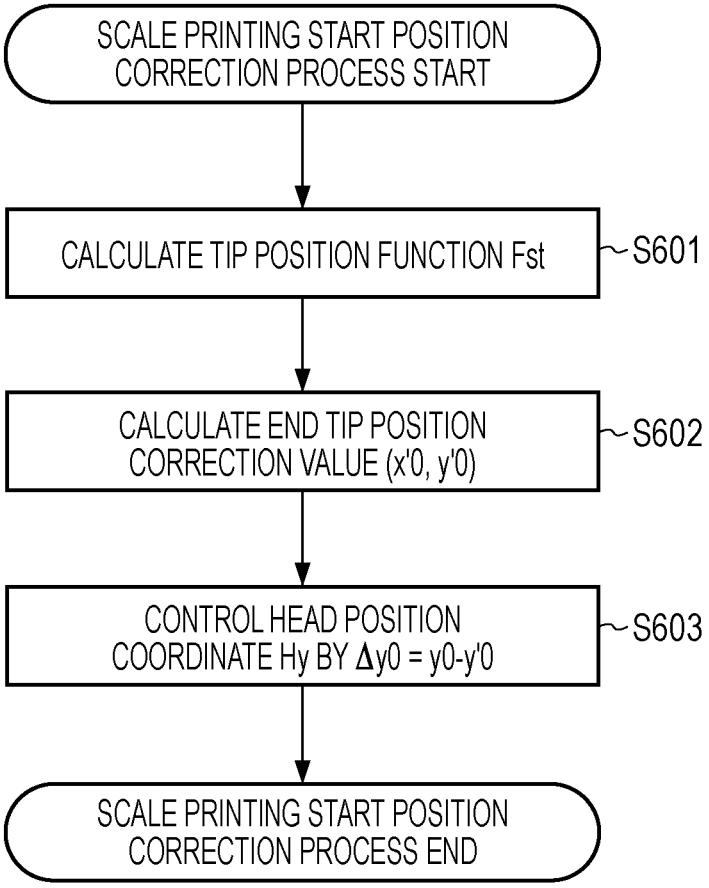
FIG. 13 is a flowchart illustrating a scale printing start position correction process.

FIG. 13 is a flowchart illustrating a scale printing start position correction process.

Next, the scale printing start position correction process performed by the controller 35 will be described with reference to FIG. 13.

As shown in FIG. 13, first, in step S601, the controller 35 reads a second tip position sensor detection value (Px4, Py4) from the memory. Subsequently, based on the read second tip position sensor detection value (Px4, Py4) and the slant calculation function Fss calculated in step S510, the tip position function Fts is calculated by Equation 27. The tip position function Fts indicates a temporal function indicating a straight line which passes a coordinate indicated by the second tip position sensor detection value and is orthogonal to the slant calculation function Fss.

$$Fts=y=a2\cdot x+b2 \tag{27}$$

Subsequently, in step S602, in which the controller 35 calculates an intersection point between Fss and Fts based on the slant calculation function Fss calculated in step S510 and the tip position function Fts calculated in step S601. Subsequently, the calculated intersection point is set to an end tip position correction value (x'0, y'0).

Subsequently, the process progresses to step S603, in which the controller 35 first subtracts y'0 from y0 based on the end tip position edge (x0, y0) calculated in step S305 and the end tip position correction value (x'0, y'0) which is the intersection point calculated in step S602. Subsequently, the subtracted result is subtracted from the head position coordinate Hy.

Subsequently, this arithmetic process is finished and the process progresses to step S514 of the original on-paper scale printing start process.

Figures 14, 14A:
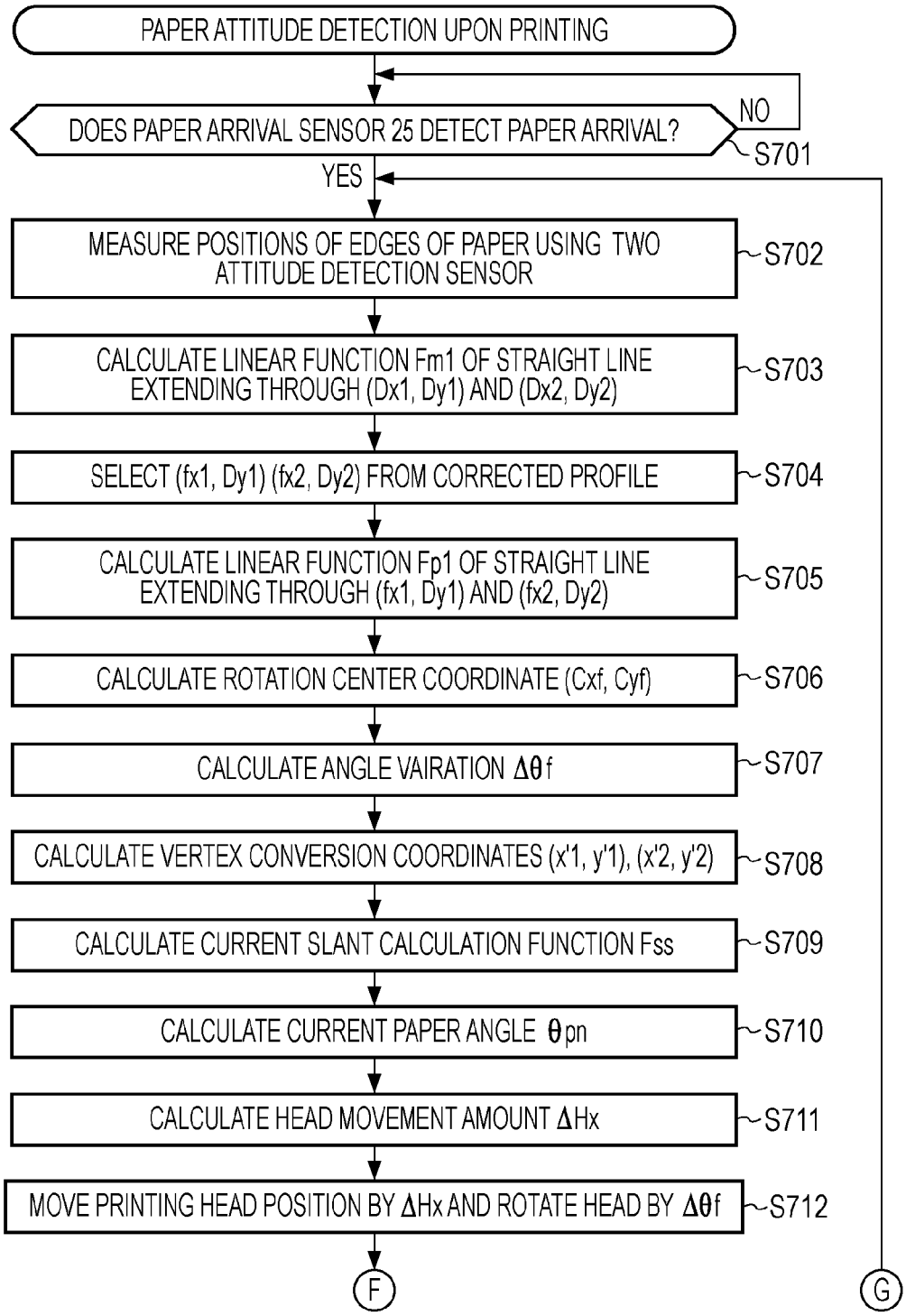
FIG. 14, including
FIGS. 14A and 14B, is a flowchart illustrating an attitude detection process for during printing.
Figure 14B:
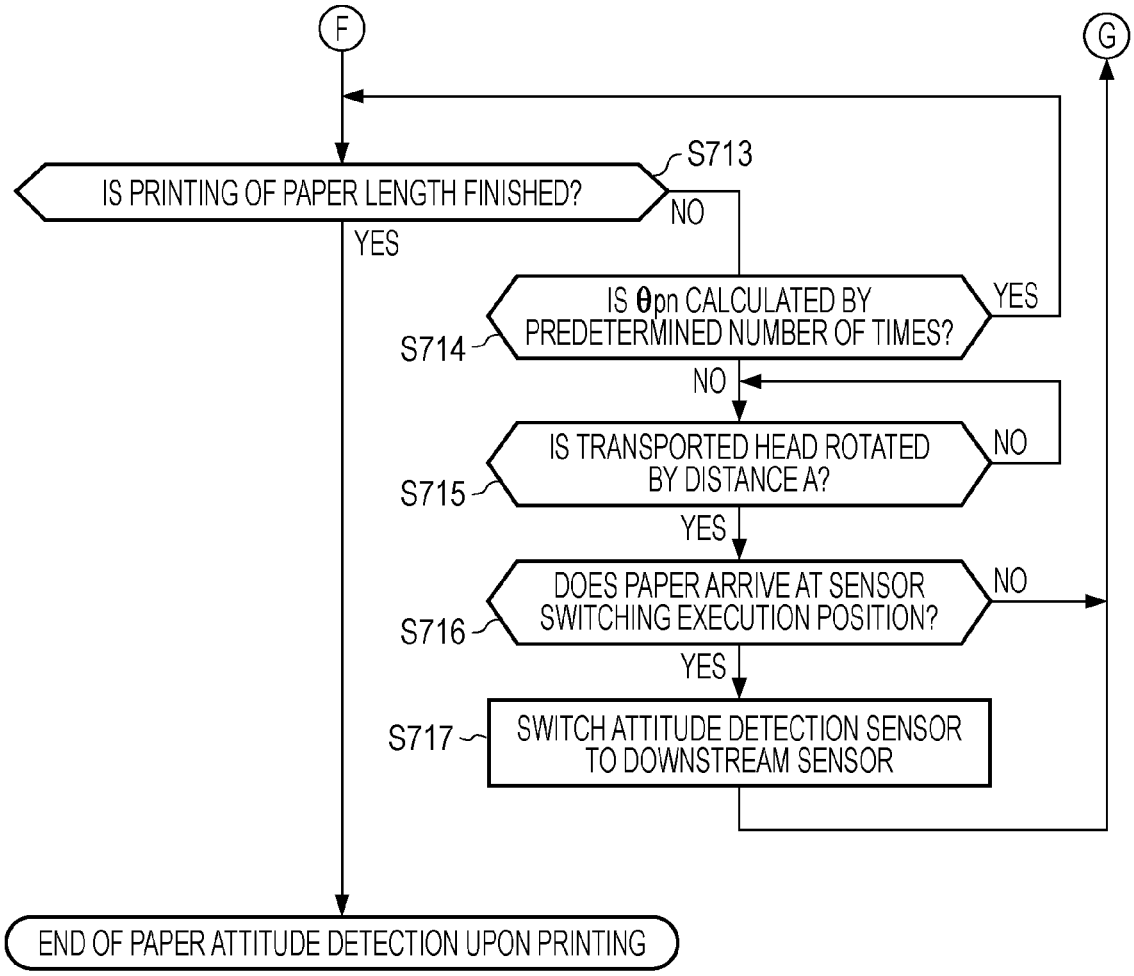

FIG. 14 is a flowchart illustrating an attitude detection process upon printing.

Next, the attitude detection process upon printing performed by the controller 35 will be described with reference to FIG. 14.

As shown in FIG. 14, first, in step S701, the controller 35 determines whether the paper P arrives at the lower side of the paper arrival sensor 25 or not.

In detail, the controller 35 first acquires the detection result from the paper arrival sensor 25. Subsequently, based on the acquired detection result, it is determined whether the paper P arrives at the lower side of the paper arrival sensor 25 or not. In addition, if it is determined whether the paper P arrives at the lower side of the paper arrival sensor 25 (Yes), the process progresses to step S702. In contrast, if it is determined that the paper P does not arrive at the lower side of the paper arrival sensor 25 (No), this step is executed again.

Subsequently, the process progresses to step S702, in which the controller 35 detects the positions of the target edges of the paper P using each of the attitude detection sensors 27*a* and 27*b*.

In detail, the controller 35 first acquires the detection result from each of the attitude detection sensors 27*a* and 27*b*. Subsequently, the y component of the coordinate value of the paper arrival sensor 25 is subtracted from the y component of the coordinate value which is the detection result acquired from the attitude detection sensors 27*a* and a distance A×j is subtracted. Here, j denotes the number of times of execution of this step after this arithmetic process begins. Subsequently, the coordinate obtained by subtraction is set to (Dx1, Dy1). Subsequently, the y component of the coordinate value of the paper arrival sensor 25 is subtracted from the y component of the coordinate value which is the detection result acquired from the attitude detection sensor 16*b* and a distance A×(j+3) is subtracted. Subsequently, the coordinate obtained by subtraction is set to (Dx2, Dy2).

Subsequently, the process progresses to step S703, in which the controller 35 calculates the function Fm1 by Equation 16 based on the (Dx1, Dy1) and (Dx2, Dy2) acquired in step S702.

Subsequently, the process progresses to step S704, in which the controller 35 first reads a corrected profile from the memory. Subsequently, a coordinate (fx1, Dy1) having a y component of Dy1 and a coordinate (fx2, Dy2) having a y component of Dy2 are selected from the read corrected profile.

Subsequently, the process progresses to step S705, in which the controller 35 calculates a function Fp1 by Equation 17 based on the coordinates (fx1, Dy1) and (fx2, Dy2) selected in step S704. The function Fp1 is a linear function indicating a straight line extending through (fx1, Dy1) and (fx2, Dy2).

Subsequently, the process progresses to step S706, in which the controller 35 calculates a rotation center coordinate (Cxf, Cyf) in the variation in attitude of the paper P.

In detail, the controller 35 calculates the rotation center coordinate (Cxf, Cyf) by Equations 18 and 19 based on a3, a4, b3 and b4 calculated in steps S703 and S705.

Subsequently, the process progresses to step S707, in which the controller 35 calculates the variation amount in attitude of the paper P from the time when the profile is acquired to the time when the coordinate (Dx, Dy) is acquired.

In detail, the controller 35 calculates an angle variation amount Δθf by Equation 20 based on the rotation center coordinate (Cxf, Cyf) calculated in step S706.

Subsequently, the process progresses to step S708, in which the controller 35 calculates vertex conversion coordinates (x'1, y'1) and (x'2, y'2) by Equation 21 based on the rotation center coordinate (Cxf, Cyf) calculated in step S706 and the angle variation amount Δθf calculated in step S707.

Subsequently, the process progresses to step S709, in which the controller 35 determines the attitude of the paper P relative to the paper transport direction.

In detail, the controller 35 calculates a slant calculation function Fss by Equation 23 based on the vertex conversion coordinates (x'1, y'1) and (x'2, y'2) calculated in step S708.

Subsequently, the process progresses to step S710, in which the controller 35 determines the attitude of the paper P.

In detail, the controller 35 calculates a paper angle θpn by Equation 24 based on a1 calculated in step S709.

In the present embodiment, the attitude of the paper P was determined based on the corrected profile indicating the shape of the target edges of the paper P and the positions of the target edges detected by the attitude detection sensors 27*a* and 27*b*. Therefore, it is possible to determine the attitude of the paper P in consideration of the shape of the target edges of the paper P. Thus, since printing on the paper P is performed by inclining the image to be printed with respect to the transport direction of the paper P based on the attitude of the paper P, it is possible to print the image to be printed on the paper P without relative displacement, even when irregularities are present in the target edges of the paper P.

Subsequently, the process progresses to step S711, in which the controller 35 first calculates a head destination coordinate Hx by Equation 25 based on the slant calculation function Fss calculated in step S709. The head destination coordinate Hx indicates the x component of the coordinate of the destination of the printing head bar 31.

Subsequently, the controller 35 calculates a head movement amount ΔHx by Equation 26 based on the calculated head destination coordinate Hx. The head movement amount ΔHx indicates a difference between the head destination coordinate Hx and the x component of the coordinates of the current position of the printing head bar 31.

Subsequently, the process progresses to step S712, in which the controller 35 performs printing on the paper P by inclining the image to be printed relative to the paper transport direction.

In detail, the controller 35 first outputs a command for moving the printing head bar 31 by the head movement amount ΔHx in the direction orthogonal to the paper transport direction to the head movement motor 32. Subsequently, a command for rotating the printing head bar 31 using the end of the printing head bar 31 as the rotation center by the angle variation amount Δθf in the horizontal plane is output to the head rotation motor 33.

By this operation, it is possible to print the image to be printed at an adequate position on the paper P.

The calculation of the head movement amount ΔHx and the movement of the printing head bar 31 are repeatedly executed during the printing of the image to be printed. Thus, even when the attitude of the paper P is varied during the printing of the image to be printed, it is possible to print the image to be printed on the paper P without relative displacement.

Subsequently, the process progresses to step S713, in which the controller 35 determines whether or not the printing head bar 31 prints the image to be printed on the overall paper P. It is determined that the image to be printed is printed on the overall paper P (Yes), this arithmetic process is finished and the original printing start process is also finished. In contrast, if it is determined that the image to be printed is not printed on the overall paper P (No), the process progresses to step S714.

In step S714, the controller 35 determines whether the calculation of the paper angle θpn is performed by a predetermined number of times or not. As the predetermined number of times, for example, the number of detection points configuring the profile may be used.

In detail, the controller 35 determines whether or not the number of times of execution of step S710 is equal to or greater than the predetermined number of times after this arithmetic process begins. If it is determined that the number of times of execution of step S710 is equal to or greater than the predetermined number of times (Yes), the process progresses to step S713. In contrast, if it is determined that the number of times of execution of step S710 is less than the predetermined number of times (No), the process progresses to step S715.

In step S715, the controller 35 determines whether the paper P is transported by the distance A or not.

In detail, the controller 35 first acquires the detection result from the printing encoder 24. Subsequently, based on the acquired detection result, it is determined whether or not the transport belt 7 of the transport unit 23 is rotated by the distance A in the paper transport direction directly after step S702 is executed. It is determined that the transport belt 7 is rotated by the distance A only in the paper transport direction (Yes), it is determined that the paper P is transported by the distance A and the process progresses to step S716. In contrast, if it is determined that the transport belt 7 is not rotated by the distance A only in the paper transport direction (No), this step is executed again.

In step S716, the controller 35 acquires the detection result from the rotary encoder 24. Subsequently, based on the acquired detection result, it is determined whether or not the paper P arrives at a sensor switching execution position. The sensor switching execution position indicates a position where the positions of the edges of the longitudinal direction of the paper P cannot be detected by the attitude detection sensors 27*a* and 27*b*. If it is determined that the paper P arrives at the sensor switching execution position (Yes), the process progresses to step S717. In contrast, if it is determined that the paper P does not arrive at the sensor switching execution position (No), the process progresses to step S702.

In step S717, the controller 35 switches the sensor used in step S702 from the attitude detection sensors 27*a* and 27*b* to the attitude detection sensor 29*a* and the attitude detection sensor 29*b* and then the process progresses to step S702.

Operation

FIG. 15 is a diagram explaining an operation of the printing device according to the embodiment of the invention.

Next, the operation of the printing device according to the present embodiment will be described with reference to the drawings.

Figure 15A:
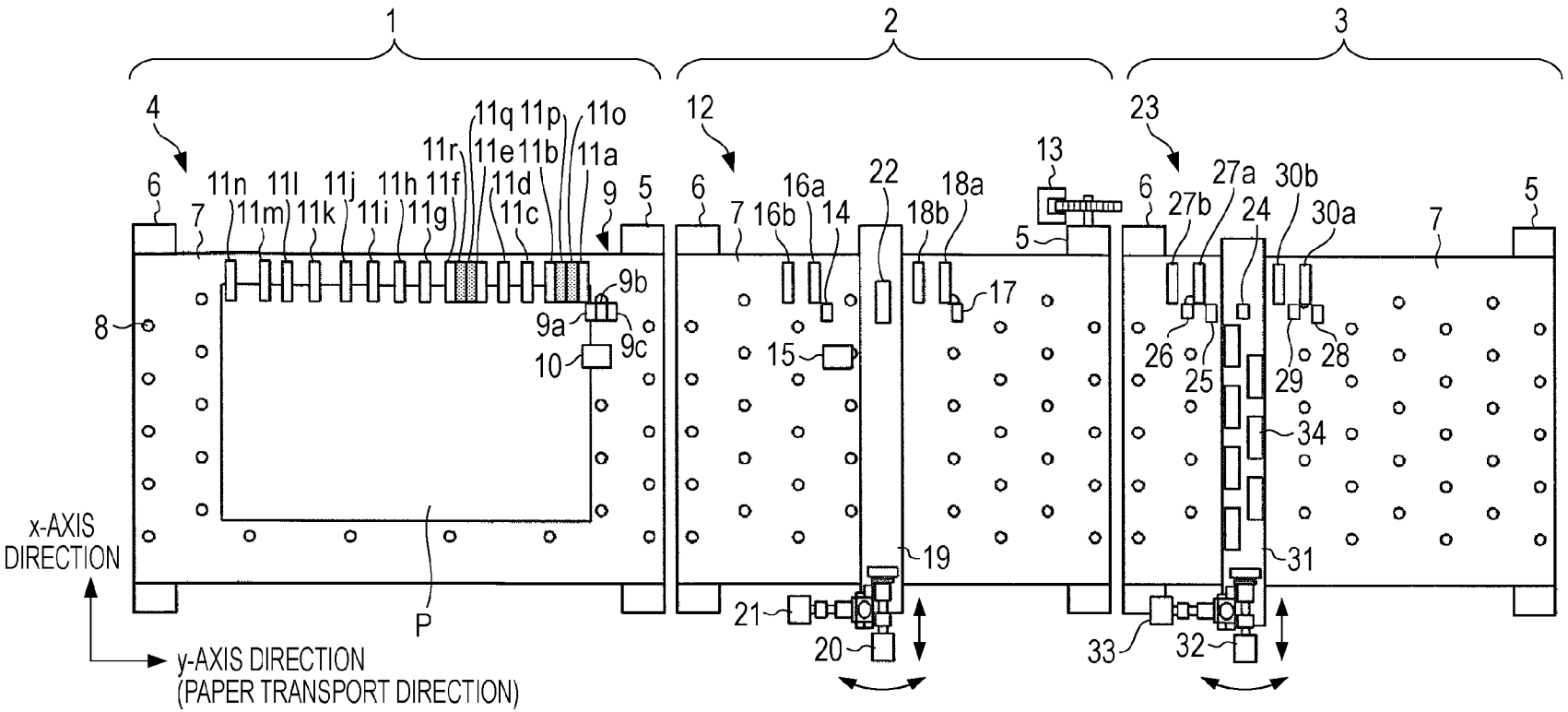
FIGS. 15A-15C are diagrams explaining an operation of the printing device.

First, as shown in FIG. 15A, the paper P is transported by the transport unit 4 so as to arrive at the lower side of the paper arrival sensor 9*a*. Then, as shown in FIGS. 3 and 4, the controller 35 executes the paper edge shape profile acquisition process so as to acquire the detection result from the paper arrival sensor 9*a*. Subsequently, the controller 35 determines that the paper P arrives at the lower side of the paper arrival sensor 9*a* based on the acquired detection result (step S201, Yes). Subsequently, as shown in FIG. 5A, the controller 35 detects the positions (first detection coordinate) of the target edges of the paper P at the lower sides of each sensor using the profile acquisition sensor 11*a* to 11*r* (step S202). Subsequently, the controller 35 sets the detection result output from the profile acquisition sensor 11*b* to P1, sets the detection result output from the profile acquisition sensor 11*f* to P2, and calculates the slant a3 and the section b3 of the linear function passing P1 and P2 (step S203). Subsequently, the controller 35 acquires the positions of the edges of the paper transport direction of the paper P passing the lower side of the tip position sensor 10 from the tip position sensor 10. Subsequently, the acquired detection result is stored in the memory as the first tip position sensor detection value (step S204). Subsequently, the controller 35 acquires the detection result from the paper arrival sensor 9*b*. Subsequently, the controller 35 determines that the paper P does not arrive at the lower side of the paper arrival sensor 9*b* based on the acquired detection result and repeatedly executes this determination (step S205, No).

While the determination is repeated, the paper P is transported by the transport unit 4 so as to arrive at the lower side of the paper arrival sensor 9*b*. Then, controller 35 determines that the paper P arrives at the lower sides of the paper arrival sensor 9*b* based on the acquired detection result (step S205, Yes). Subsequently, as shown in FIG. 5B, the controller 35 detects the positions (second detection coordinate) of the target edges of the paper P at the lower side of each sensor using the profile acquisition sensor 11*a* to 11*r* (step S206). Subsequently, the controller 35 sets the detection result output from the profile acquisition sensor 11*p* to P3, sets the detection result output from the profile acquisition sensor 11*r* to P4, and calculates the slant a4 and the section b4 of the linear function passing P3 and P4 (step S207). Subsequently, the controller 35 calculates the variation amount of attitude of the paper P from the time when the first detection coordinate is detected to the time when the second detection coordinate is detected (step S208). Subsequently, the corrected second detection coordinate, which is the coordinate obtained by eliminating, from the second detection coordinate, the paper attitude variation (paper position, paper angle, or the like) component from the time when the first detection coordinate is detected to the time when the second detection coordinate is detected, is calculated (step S209). Subsequently, the controller 35 acquires the detection result from the paper arrival sensor 9*c*. Subsequently, the controller 35 determines that the paper P does not arrive at the lower side of the paper arrival sensor 9*c* based on the acquired detection result and repeatedly executes this determination (step S210, No).

While the determination is repeated, the paper P is transported by the transport unit 4 so as to arrive at the lower side of the paper arrival sensor 9*c*. Then, controller 35 determines that the paper P arrives at the lower side of the paper arrival sensor 9*c* based on the acquired detection result (step S210, Yes). Subsequently, as shown in FIG. 5C, the controller 35 detects the positions (third detection coordinate) of the target edges of the paper P at the lower sides of each sensor using the profile acquisition sensor 11*a* to 11*r* (step S211). Subsequently, the controller 35 sets the detection result output from the profile acquisition sensor 11*o* to P3, sets the detection result output from the profile acquisition sensor 11*q* to P4, and calculates the slant a4 and the section b4 of the linear function passing P3 and P4 (step S212). Subsequently, the controller 35 calculates the variation amount of the slant of the paper P relative to the paper transport direction from the time when the first detection coordinate is detected to the time when the third detection coordinate is detected (step S213). Subsequently, the controller 35 calculates the corrected third detection coordinate, which is the coordinate obtained by eliminating, from the third detection coordinate, the paper variation (paper position, paper angle, or the like) component from the time when the first detection coordinate is detected to the time when the third detection coordinate is detected (step S214). Subsequently, the controller 35 reads the first detection coordinate, the corrected second detection coordinate and the corrected third detection coordinate from the memory. Subsequently, the controller 35 synthesizes the read first detection coordinate, that obtained by subtracting the distance A from the y component of each coordinate value of the corrected second detection coordinate, and that obtained by subtracting the distance 2A from the y component of each coordinate value of the corrected third detection coordinate. Subsequently, as shown in FIG. 6, the controller 35 stores the synthesized result in the memory as the profile indicating the shape of the edges of the paper P (step S215).

Subsequently, as shown in FIG. 7, the controller 35 executes the paper initial-attitude calculation process and selects two vertex coordinates (x1, y1) and (x2, y2) from the profile acquired in the paper edge shape profile acquisition process (step S301). Subsequently, as shown in FIG. 9, the controller 35 calculates the slant calculation function Fsp indicating the straight line extending through the vertex coordinates (x1, y1) and (x2, y2). Subsequently, the controller 35 reads the first tip position sensor detection value from the memory. Subsequently, the controller 35 calculates the tip position function Ftp indicating the straight line which passes the coordinate value indicated by the first tip position sensor detection value and is orthogonal to the slant calculation function Fsp, based on the read first tip position sensor detection value (step S303). Subsequently, the controller 35 reads the profile from the memory. Subsequently, the controller 35 subtracts the y component y0 of the end tip position edge (x0, y0) from the y component of each coordinate value of the read profile. Subsequently, the controller 35 stores the coordinate value obtained by subtraction in the memory as the corrected profile (step S305). Subsequently, the controller 35 calculates the initial slant θini indicating the slant of the slant calculation function Fsp relative to the paper transport direction based on the coefficient a1 of the slant calculation function Fsp and finishes this arithmetic process (step S306).

Subsequently, as shown in FIG. 11, the controller 35 executes the on-paper scale printing start process and acquires the detection result from the paper arrival sensor 14. Subsequently, the controller 35 determines that the paper P does not arrive at the lower side of the paper arrival sensor 14 based on the acquired detection result and executes this determination (step S501, No).

Figure 15B:
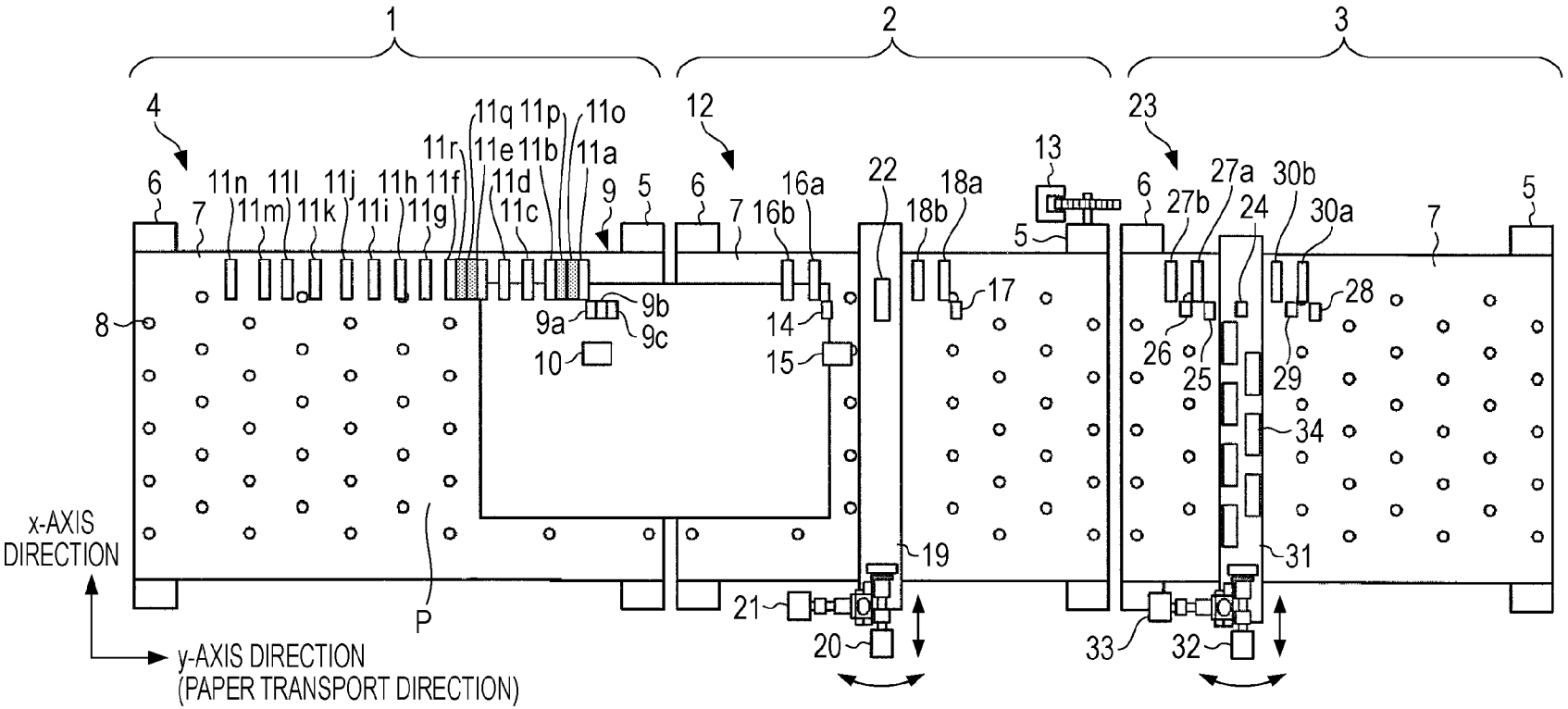

While the determination is repeated, as shown in FIG. 15B, the paper P is transported by the transport unit 12 so as to arrive at the lower side of the paper arrival sensor 14. Then, controller 35 determines that the paper P arrives at the lower side of the paper arrival sensor 14 based on the acquired detection result (step S501, Yes). Subsequently, the controller 35 detects the positions of the edges of the paper transport direction of the paper P passing the lower side of the tip position sensor 15 using the tip position sensor 15 (step S502). Subsequently, as shown in FIG. 12A, the controller 35 acquires (Dx1, Dy1) and (Dx2, Dy2) based on the positions of the target edges of the paper P at the lower sides of each sensor using the attitude detection sensors 16*a* and 16*b* (step S503). Subsequently, the controller 35 calculates the function Fm1 indicating the straight line extending through (Dx1, Dy1) and (Dx2, Dy2) based on the acquired (Dx1, Dy1) and (Dx2, Dy2) (step S504).

Subsequently, the controller 35 reads the corrected profile from the memory. Subsequently, as shown in FIG. 12B, the controller 35 selects the coordinate (fx1, Dy1) having the y component of Dy1 and the coordinate (fx2, Dy2) having the y component of Dy2 from the read corrected profile (step S505). Subsequently, the controller 35 calculates the function Fp1 indicating the straight line extending through (fx1, Dy1) and (fx2, Dy2) based on the selected coordinates (fx1, Dy1) and (fx2, Dy2) (step S506). Subsequently, as shown in FIG. 12C, the controller 35 calculates the rotation center coordinate (Cxf, Cyf) indicating the coordinate of the intersection point between the straight line extending through (Dx1, Dy1) and (Dx2, Dy2) and the straight line extending through (fx1, Dy1) and (fx2, Dy2) (step S507). Subsequently, the controller 35 calculates the angle variation amount Δθf indicating the variation amount in attitude of the paper P from the time when the profile is acquired to the time when the coordinates (Dx1, Dy1) and (Dx2, Dy2) are acquired, based on the rotation center coordinate (Cxf, Cyf) (step S508). Subsequently, the controller 35 calculates the vertex conversion coordinates (x'1, y'1) and (x'2, y'2) which are the coordinates when the vertex coordinates (x1, y1) and (x2, y2) are rotated around the rotation center coordinate (Cxf, Cyf) by the angle variation amount Δθf (step S509). Subsequently, the controller 35 calculates the slant calculation function Fss indicating the straight line extending through the vertex conversion coordinates (x'1, y'1) and (x'2, y'2) based on the calculated vertex conversion coordinates (x'1, y'1) and (x'2, y'2) (step S510). Subsequently, the controller 35 calculates the paper angle θpn indicating the slant of the slant calculation function Fss relative to the paper transport direction (step S511).

In the present embodiment, the attitude of the paper P at the time of printing the scale was determined based on the angle between the straight line passing (Dx1, Dy1) and (Dx2, Dy2) and the straight line passing (fx1, Dy1) and (fx2, Dy2). Therefore, it is possible to more adequately determine the attitude of the printing medium.

Subsequently, the controller 35 corrects the head position coordinate Hy indicating the position of the paper transport direction of the printing head bar 19 (steps S512 and S513). Subsequently, the controller 35 calculates the head destination coordinate Hx which is the x component of the coordinate of the destination of the printing head bar 19, based on the slant calculation function Fss. Subsequently, the controller 35 calculates the head movement amount ΔHx based on the head destination coordinate Hx (step S514). Subsequently, the controller 35 outputs the command for moving the printing head bar 19 by the head movement amount ΔHx to the head movement motor 20. Subsequently, the controller 35 outputs the command for rotating the printing head bar 19 by the angle variation amount Δθf to the head rotation motor 21 (step S515).

When the command is output from the controller 35, the head movement motor 20 moves the printing head bar 19 by the head movement amount ΔHx in the direction orthogonal to the paper transport direction. Similarly, the head rotation motor 21 rotates the printing head bar 19 using the end of the printing head bar 19 as the rotation center by the angle variation amount Δθf in the horizontal plane.

By this operation, it is possible to perform printing on the paper P by inclining the scale based on the attitude of the paper P. Therefore, it is possible to print the scale on the paper P without relative displacement.

Subsequently, the controller 35 determines that the printing head bar 19 does not print the scale on all the target edges of the paper P (step S516, No). Subsequently, the controller 35 determines that the calculation of the current paper angle θpn is not performed by the predetermined number of times (step S517, No). Subsequently, the controller 35 acquires the detection result from the rotary encoder 13. Subsequently, based on the acquired detection result, directly after step S503 is executed, it is determined that the transport belt 7 of the transport unit 12 is not rotated by the distance A in the paper transport direction and this determination is repeatedly executed (step S518, No).

While the determination is repeated, the transport belt 7 of the transport unit 12 is rotated by the distance A in the paper transport direction. Then, the controller 35 determines that the transport belt 7 is rotated by the distance A only in the paper transport direction, based on the acquired detection result (step S518, Yes). Subsequently, it is determined that the paper P does not arrive at the sensor switching execution position and the flow is repeated from step S503 (step S519, No).

By this operation, it is possible to print the scale on all the edges of the paper P without displacement.

In the present embodiment, the attitude of the paper P was determined based on the corrected profile indicating the shape of the target edges of the paper P and the positions of the target edges detected by the attitude detection sensors 16*a* and 16*b*. Therefore, it is possible to determine the attitude of the paper P in consideration of the shape of the target edges of the paper P. Thus, since printing on the paper P is performed by inclining the scale with respect to the transport direction of the paper P based on the attitude of the paper P, it is possible to print the scale on the paper P without relative displacement, even when irregularities are present in the target edges of the paper P.

While the flow is repeated, the scale is printed on all the edges of the paper P. Then, the controller 35 finishes this arithmetic process (step S516, Yes). Subsequently, as shown in FIG. 11, the controller 35 executes the paper attitude detection process upon printing and acquires the detection result from the paper arrival sensor 25. Subsequently, the controller 35 determines that the paper P does not arrive at the lower side of the paper arrival sensor 25, based on the acquired detection result, and repeatedly executes this determination (step S701, No).

Figure 15C:
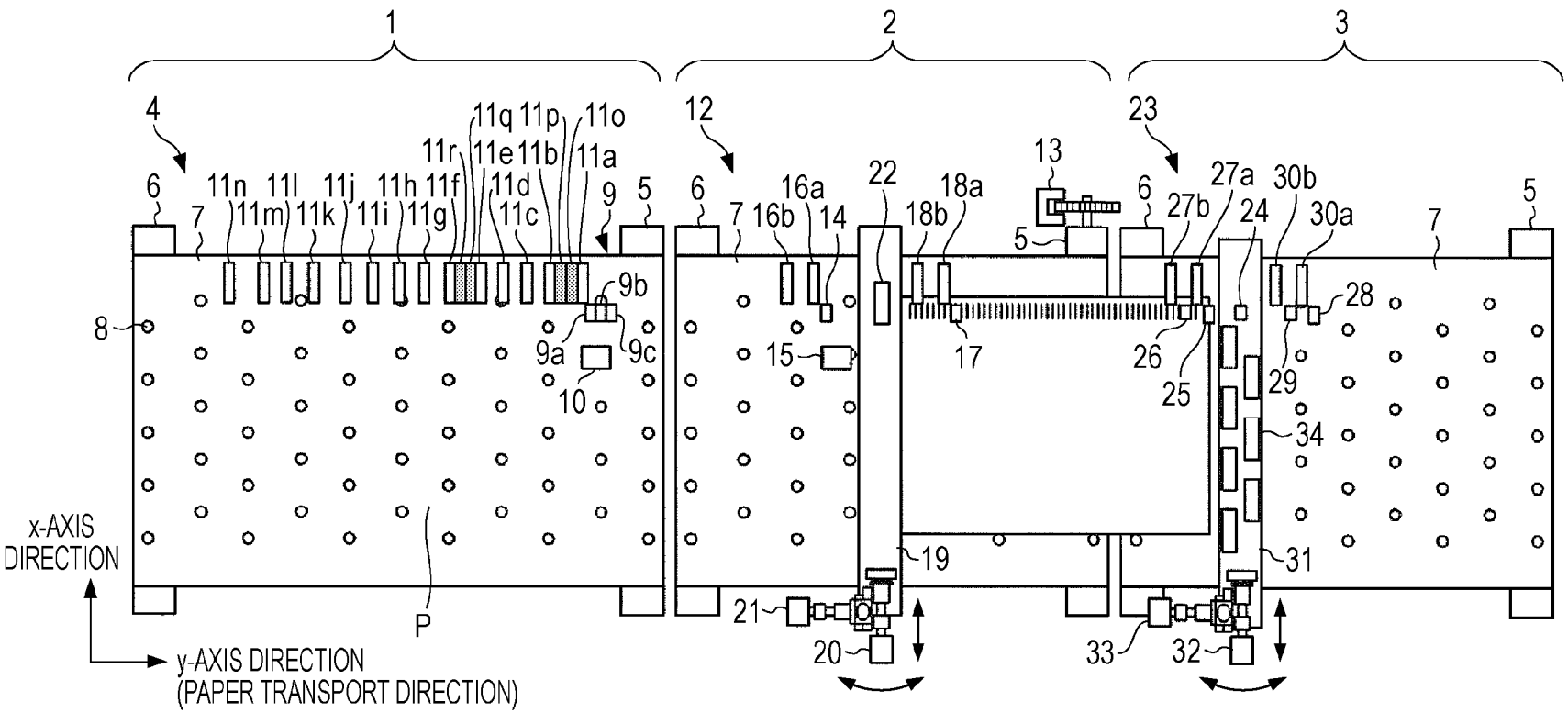

Here, while the flow is repeated, as shown in FIG. 15C, the paper P is transported by the transport unit 23 so as to arrive at the lower side of the sixth paper arrival sensor 14. Then, the controller 35 determines that the paper P arrives at the lower side of the sixth paper arrival sensor 14 based on the acquired detection result (step S701, Yes). Subsequently, the controller 35 acquires (Dx1, Dy1) and (Dx2, Dy2) based on the positions of the target edges of the paper P at the lower sides of each sensor using the attitude detection sensors 27*a* and 27*b* (step S702). Subsequently, the controller 35 calculates the function Fm1 indicating the straight line extending through the acquired (Dx1, Dy1) and (Dx2, Dy2) (step S703).

Subsequently, the controller 35 reads the corrected profile from the memory. Subsequently, the controller 35 selects the coordinate (fx1, Dy1) of the y component of Dy1 and the coordinate (fx2, Dy2) having the y component of Dy2 from the read corrected profile (step S704). Subsequently, the controller 35 calculates the function Fp1 indicating the straight line extending through (fx1, Dy1) and (fx2, Dy2) based on the selected coordinates (fx1, Dy1) and (fx2, Dy2) (step S705). Subsequently, the controller 35 calculates the rotation center coordinate (Cxf, Cyf) indicating the coordinate of the intersection point between the straight line extending through (Dx1, Dy1) and (Dx2, Dy2) and the straight line extending through (fx1, Dy1) and (fx2, Dy2) (step S706). Subsequently, the angle variation amount Δθf attitude of the attitude of paper P from the time when the profile is acquired to the time when the coordinate (Dx, Dy) is acquired is calculated (step S707). Subsequently, the controller 35 calculates the vertex conversion coordinates (x'1, y'1) and (x'2, y'2) which are the coordinates when the vertex coordinates (x1, y1) and (x2, y2) are rotated around the rotation center coordinate (Cxf, Cyf) by the angle variation amount Δθf (step S708). Subsequently, the controller 35 calculates the slant calculation function Fss indicating the straight line extending through the vertex conversion coordinates (x'1, y'1) and (x'2, y'2) based on the calculated vertex conversion coordinates (x'1, y'1) and (x'2, y'2) (step S709). Subsequently, the controller 35 calculates the paper angle θpn indicating the slant of the slant calculation function Fss relative to the paper transport direction based on the coefficient a1 of the slant calculation function Fss (step S710).

In the present embodiment, the attitude of the paper P at the time of printing the image to be printed was determined based on the angle between the straight line passing (Dx1, Dy1) and (Dx2, Dy2) and the straight line passing (fx1, Dy1) and (fx2, Dy2). Therefore, it is possible to more adequately determine the attitude of the printing medium.

Subsequently, the controller 35 calculates the head destination coordinate Hx which is the x component of the coordinate of the destination of the printing head bar 31 based on the slant calculation function Fss. Subsequently, the controller 35 calculates the head movement amount ΔHx (step S711). Subsequently, the controller 35 outputs the command for moving the printing head bar 31 by the head movement amount ΔHx to the head movement motor 32. Subsequently, the controller 35 outputs the command for rotating the printing head bar 31 by the angle variation amount Δθf to the head rotation motor 33 (step S712).

When the command is output from the controller 35, the head movement motor 32 moves the printing head bar 31 by the head movement amount ΔHx in the direction orthogonal to the paper transport direction. Similarly, the head rotation motor 33 rotates the printing head bar 31 using the end of the printing head bar 31 as the rotation center by the angle variation amount Δθf in the horizontal plane.

By this operation, it is possible to perform printing on the paper P by inclining the image to be printed based on the attitude of the paper P. Therefore, it is possible to print the image to be printed on the paper P without relative displacement.

Subsequently, the controller 35 determines that the printing head bar 31 does not print the image to be printed on the overall paper P (step S713, No). Subsequently, the controller 35 determines that the calculation of the current paper angle θpn is not performed by the predetermined number of times (step S714, No). Subsequently, the controller 35 acquires the detection result from the paper position detection encoder 26. Subsequently, the controller 35 determines that the transport belt 7 of the transport unit 23 is not rotated by the distance A in the paper transport direction, based on the acquired detection result, directly after executing step S702, and repeatedly executes this determination (step S715, No).

While the determination is repeated, the transport belt 7 of the transport unit 23 is rotated by the distance A in the paper transport direction. Then, the controller 35 determines that the transport belt 7 is rotated by the distance A only in the paper transport direction, based on the acquired detection result (step S715, Yes). Subsequently, it is determined that the paper P does not arrive at the sensor switching execution position and the flow is repeated from step S702 (step S716, No).

By this operation, it is possible to print the image to be printed on all of the paper P without displacement.

In the present embodiment, the attitude of the paper P was determined based on the corrected profile indicating the shape of the target edges of the paper P and the positions of the target edges detected by the attitude detection sensors 27*a* and 27*b*. Therefore, it is possible to determine the attitude of the paper P in consideration of the shape of the target edges of the paper P. Thus, since printing on the paper P is performed by inclining the image to be printed with respect to the transport direction of the paper P based on the attitude of the paper P, it is possible to print the image to be printed on the paper P without relative displacement, even when irregularities are present in the target edges of the paper P.

In the present embodiment, the paper P of FIG. 1 configures a printing medium. The transport units 4, 12 and 23 of FIG. 1 configure a transport unit. The printing head bars 19 and 31, the head movement motors 20 and 32 and the head rotation motors 21 and 33 of FIG. 1 configure a printing unit. The profile acquisition sensors 11*a* to 11*n*, the controller 35 and steps S201 to S215 of FIG. 4 configure a shape detection unit and a shape detection process. The attitude detection sensors 16*a*, 16*b*, 18*a*, 18*b*, 27*a*, 27*b*, 30*a* and 30*b* and the controller 35 of FIG. 1, step S503 of FIG. 11, and step S702 of FIG. 14 configure a position detection unit and a position detection process. The controller 35 of FIG. 1, steps S504 to S508 of FIG. 11 and steps S703 to S710 of FIG. 14 configure a first determination unit and a determination process. The profile acquisition sensors 11*a* to 11*n* configure a first sensor. The step S215 of FIG. 4 configures a position acquisition unit. The profile acquisition sensors 110 to 11*r* configure a second sensor. The controller 35 of FIG. 1 and steps S208 and S213 of FIG. 4 configure a second determination unit. The controller 35 of FIG. 1 and steps S209 and S214 of FIG. 4 configure a correction unit.

Modified Example

Although the scale is printed on the vicinities of the target edges of the paper P and the scale is detected so as to detect the transport amount of the paper P at the time of printing the image to be printed in the present embodiment, other configurations may be employed. For example, if the transport amount of the paper P can be accurately detected by a rotary encoder or the like, the scale may not be printed on the paper P.

Although an example of applying the printing device of the invention to a line type ink jet printing device is described in the present embodiment, other configurations may be employed. For example, the invention is applicable to a serial type ink jet printing device, a laser printer, a thermal transfer printer, or the like.

What is claimed is:

1. A printing device comprising:

a transport unit configured to transport a sheet-shape printing medium;

a printing unit configured to print an image on the printing medium transported by the transport unit;

a shape detection unit configured to detect the shape of edges of the printing medium;

a position detection unit configured to detect the positions of the edges when an image is printed on the printing medium by the printing unit; and a first determination unit configured to determine the attitude of the printing medium based on the shape of the edges detected by the shape detection unit and the positions of the edges detected by the position detection unit, wherein the printing unit controls a printing position based on the attitude of the printing medium determined by the first determination unit and performs printing on the printing medium;

wherein the shape detection unit detects a plurality of positions of the target edges which are edges of the printing medium in a direction orthogonal to a transport direction as the shape of the edges, wherein, the position detection unit detects two locations of the plurality of locations when the image is printed on the printing medium by the printing unit, and wherein, the first determination unit determines the attitude of the printing medium based on an angle between a straight line passing through the two positions of the plurality of positions detected by the shape detection unit and a straight line passing through the two positions detected by the position detection unit.

2. The printing device according to claim 1, wherein the shape detection unit includes a plurality of first sensors arranged at positions facing positions passing the target edges in parallel along the transport direction so as to detect the positions of the facing target edges.

3. The printing device according to claim 2, wherein:

the plurality of first sensors is arranged respectively at an interval, which is an integral multiple of 2 times or more of a predetermined distance, so as to detect the positions of the facing target edges whenever the printing medium is transported by the predetermined distance, and the shape detection unit includes a position acquisition unit configured to synthesize detection results of the plurality of first sensors and to create the plurality of positions.

4. The printing device according to claim 3, wherein the shape detection unit includes:

second sensors arranged at positions facing positions passing the target edges with the predetermined distance from any one of the plurality of first sensors so as to detect the positions of the facing target edges;

a second determination unit configured to determine a variation in attitude of the printing medium based on the positions of the target edges detected by the plurality of first sensors and the positions of the target edges detected by the plurality of second sensors; and a correction unit configured to correct the plurality of positions detected by the first sensors based on the variation in attitude of the printing medium determined by the second determination unit.

5. A method of controlling a printing device for transporting a sheet-shaped printing medium and printing an image on the printing medium, the method comprising:

detecting the shape of edges of the printing medium before the image is printed on the printing medium and detecting a plurality of positions of the target edges which are edges of the printing medium in a direction orthogonal to a transport direction as the shape of the edges;

detecting the positions of the edges when the image is printed on the printing medium including detecting two locations of the plurality of locations when the image is printed on the printing medium by the printing unit;

determining the attitude of the printing medium based on the detected shape of the edges and the detected positions of the edges including determining the attitude of the printing medium based on an angle between a straight line passing through the two positions of the plurality of positions detected by the shape detection unit and a straight line passing through the two positions detected by the position detection unit, wherein a printing position is controlled based on the determined attitude of the printing medium so as to perform printing on the printing medium.

* * * * *